US012656002B2

(12) United States Patent
Kim et al.

(10) Patent No.: US 12,656,002 B2
(45) Date of Patent: Jun. 16, 2026

(54) AIR PURIFIER

(71) Applicant: COWAY Co., Ltd., Gongju-si (KR)

(72) Inventors: Jae Hoon Kim, Gongju-si (KR); Young Choon Park, Gongju-si (KR); Seon Ho Lee, Gongju-si (KR); Jun Hyoung Bae, Gongju-si (KR); Dong Hee Jang, Gongju-si (KR)

(73) Assignee: COWAY Co., Ltd., Gongju-si (KR)

( * ) Notice: Subject to any disclaimer, the term of this patent is extended or adjusted under 35 U.S.C. 154(b) by 340 days.

(21) Appl. No.: 18/406,921

(22) Filed: Jan. 8, 2024

(65) Prior Publication Data

US 2024/0240815 A1 Jul. 18, 2024

(30) Foreign Application Priority Data

Jan. 12, 2023 (KR) ..... 10-2023-0004988

(51) Int. Cl.
*F24F 8/108* (2021.01)
*A47L 9/28* (2006.01)
(Continued)

(52) U.S. Cl.
CPC ..... *F24F 8/108* (2021.01); *A47L 9/2873* (2013.01); *F24F 11/63* (2018.01); *F24F 11/755* (2018.01); *A47L 2201/02* (2013.01); *F24F 8/90* (2021.01)

(58) Field of Classification Search
CPC .... A47L 9/2873; A47L 2201/02; A47L 9/106; F24F 11/63; F24F 11/755; F24F 8/90;
(Continued)

(56) References Cited

U.S. PATENT DOCUMENTS 9,423,128 B2 * 8/2016 Gans ..... F23L 17/005
10,165,734 B1 * 1/2019 Shelor ..... F24F 11/70
(Continued)

FOREIGN PATENT DOCUMENTS

KR 10-2021-0110427 A 9/2021
KR 10-2022-0086405 A 6/2022

*Primary Examiner* — Dung H Bui
(74) *Attorney, Agent, or Firm* — Oblon, McClelland, Maier & Neustadt, L.L.P.

(57) ABSTRACT

An air purifier is disclosed. The air purifier according to an aspect of the present invention may include a housing that forms an external shape and has a housing space therein that communicates with the outside; and an air purification unit that is coupled to the housing, comprises a fan member that provides a conveying force to allow external air to be introduced into the housing space of the housing, and a filter member that filters external air introduced into the housing space, and purifies the external air introduced into the housing space and then discharges it to the outside, wherein the housing includes a clean inlet part partially surrounding the housing space, formed through one or more surfaces of the housing, and communicating the housing space and the outside; and a dust inlet part partially surrounding the housing space, formed through one or more surfaces of the housing, and communicating the housing space and the outside at a position different from the clean inlet part, wherein the clean inlet part is configured to be open or closed, and when the clean inlet part is closed, the speed of external air introduced into the dust inlet part is increased by the fan member.

12 Claims, 22 Drawing Sheets

(51) Int. Cl.
*F24F 11/63* (2018.01)
*F24F 11/755* (2018.01)
*F24F 8/90* (2021.01)

(58) Field of Classification Search
CPC ..... F24F 8/10; F24F 8/80; F24F 13/28; F24F 11/74; F24F 13/10; F24F 13/20; F24F 2013/205
See application file for complete search history.

(56) References Cited

U.S. PATENT DOCUMENTS

| | | | | |
|---|---|---|---|---|
| 2007/0205297 | A1* | 9/2007 | Finkam | F24F 11/30 236/1 C |
| 2011/0053488 | A1* | 3/2011 | Gans | F24F 7/025 454/343 |
| 2016/0370029 | A1* | 12/2016 | Kurelowech | F24F 12/006 |
| 2017/0036217 | A1* | 2/2017 | Barkie | F24F 8/192 |
| 2017/0241657 | A1* | 8/2017 | Salsbury | F24F 11/63 |
| 2018/0112886 | A1* | 4/2018 | Boody | F24F 11/30 |
| 2020/0132324 | A1* | 4/2020 | Rigg | F24F 11/72 |
| 2021/0207838 | A1* | 7/2021 | Harrison | G06N 5/04 |
| 2022/0090807 | A1* | 3/2022 | Grefsheim | F24F 11/63 |
| 2023/0027821 | A1* | 1/2023 | Wei | F24F 1/0035 |
| 2023/0255418 | A1* | 8/2023 | Choi | A47L 9/1409 15/319 |
| 2023/0284854 | A1* | 9/2023 | Choi | A47L 9/2873 |
| 2023/0408130 | A1* | 12/2023 | Boyd | F24F 11/65 |
| 2024/0240815 | A1* | 7/2024 | Kim | F24F 8/10 |

* cited by examiner

AIR PURIFIER

TECHNICAL FIELD

The present invention relates to an air purifier, and more specifically, to an air purifier that can perform a cleaning function by sucking in foreign substances remaining in the surrounding environment where it is installed.

BACKGROUND

An air purifier refers to a series of apparatuses that can suck in air, purify it, and discharge it back to the outside. As the demand for clean air has recently increased, air purifiers are being installed in various spaces where people reside, such as homes or companies.

Typically, an air purifier is configured to include a component for sucking and discharging surrounding air and a component for filtering the sucked air. For example, an air purifier includes components for forming a flow of air, such as a fan, and components for filtering the sucked air, such as a filter.

In this case, when the air located outside the air purifier is moved by a fan, etc., dust, etc. mixed with the air may flow together toward the air purifier. Dust, etc. that are introduced into the air purifier along with the air can be filtered by a filter. On the other hand, dust, etc. that does not enter the air purifier remains on the outside of the air purifier.

Specifically, a relatively light mass of dust, etc. may be introduced into the air purifier together with the air. On the other hand, relatively heavy mass dust, etc. flows toward the air purifier along with the air, but may be separated from the air and stay around the air purifier. If the above process is repeated, there is a risk that the environment around the air purifier may be polluted by retained dust, etc.

In addition, if relatively heavy mass dust, etc. are introduced into the air purifier, the service life of the filter may be reduced. In addition, there is a risk that introduced dust, etc. may clog the filter, reducing the air cleaning effect.

Therefore, in order to improve the cleaning effect of the air purifier and increase the service life of the filter, etc., a method for removing dust, etc. remaining in the environment around the air purifier is required.

Korean Patent Laid-Open Publication No. 10-2022-0086405 discloses a cube-type air purifier with a dust, etc. suction function. Specifically, it discloses a cube-type air purifier with a dust, etc. suction function that can perform both a dust, etc. suction function and an air purification function.

However, the cube-type air purifier disclosed in the above-described related art document separately includes a cube that performs a dust, etc. suction function and a cube that performs an air purification function. In addition, each cube is not in communication but communicates with the outside independently of each other. That is, the cube-type air purifier disclosed in the above related art document can achieve its purpose only if it is equipped with both one cube, which is responsible for the dust, etc. suction function and another cube, which is responsible for the air purification function.

Therefore, the cube-type air purifier disclosed in the above related art document must be equipped with a plurality of cubes to perform its function. Therefore, in order to achieve both the dust, etc. suction function and the air purification function, the volume is inevitably increased.

In addition, the cube-type air purifier disclosed in the above related art document is provided in a form that is stacked in the up-down direction. That is, the height at which air is sucked in and the height at which dust, etc. are sucked, are configured to be different. In particular, the dust, etc. suction cube is placed at the very top, so it is difficult for dust, etc. remaining on the floor to be sucked in.

Korean Patent Laid-Open Publication No. 10-2021-0110427 discloses a docking station capable of carrying an air purifier and a robot vacuum cleaner system having the same. Specifically, it discloses a robot vacuum cleaner system that includes a robot vacuum cleaner capable of autonomous driving and a docking station capable of carrying an air purifier that charges the robot vacuum cleaner.

However, in the robot vacuum cleaner system disclosed in the above related art document, a dust, etc. flow passage and an air purification flow passage are formed separately. Therefore, in order to block arbitrary communication by physically separating the dust, etc. flow passage and the air purification flow passage, the volume of the docking station must be increased.

In addition, in the robot vacuum cleaner system disclosed in the above related art document, the air intake port through which air to be cleaned flows in is always open. Therefore, it is difficult to adjust the flow rate of the dust, etc. flow passage and the air purification flow passage, and there is a limitation in that a lot of electric power is required to introduce both dust, etc. and air along the two flow passages.

RELATED ART DOCUMENT

Patent Document

Korean Patent Laid-Open Publication No. 10-2022-0086405 (2022 Jun. 23)

Korean Patent Laid-Open Publication No. 10-2021-0110427 (2021 Sep. 8)

SUMMARY OF THE INVENTION

Technical Problem

The present invention is to solve the above problems, and is directed to providing an air purifier having a structure capable of removing dust remaining outside.

The present invention is also directed to providing an air purifier having a structure that can effectively remove dust remaining outside.

The present invention is also directed to providing an air purifier having a structure that can easily remove dust collected therein.

The present invention is also directed to providing an air purifier having a structure that can improve power efficiency.

The present invention is also directed to providing an air purifier having a structure that can effectively collect dust, etc. introduced with the air.

The problems of the present invention are not limited to those mentioned above, and other problems not mentioned will be clearly understood by those of ordinary skill in the art from the following description.

Technical Solution

According to an aspect of the present invention, provided is an air purifier, comprising a housing that forms an external shape and has a housing space therein that communicates with the outside; and an air purification unit that is coupled to the housing, comprises a fan member that provides a conveying force to allow external air to be introduced into the housing space of the housing, and a filter member that filters external air introduced into the housing space, and purifies the external air introduced into the housing space and then discharges it to the outside, wherein the housing includes a clean inlet part partially surrounding the housing space, formed through one or more surfaces of the housing, and communicating the housing space and the outside; and a dust inlet part partially surrounding the housing space, formed through one or more surfaces of the housing, and communicating the housing space and the outside at a position different from the clean inlet part, wherein the clean inlet part is configured to be open or closed, and when the clean inlet part is closed, the speed of external air introduced into the dust inlet part is increased by the fan member.

In this case, an air purifier may be provided in which a lower end of the dust inlet part is located lower than a lower end of the clean inlet part.

In addition, an air purifier may be provided in which the dust inlet part is formed extending in the width direction of the housing.

In this case, an air purifier may be provided in which the air purifier includes a power member coupled to the fan member and configured to rotate the fan member.

In addition, an air purifier may be provided in which the air purification unit includes a control member energizably connected to the power member and configured to apply a control signal or power to the power member, and the control member is configured to control the power member such that a rotation speed of the power member is increased when the clean inlet part is closed.

In this case, an air purifier may be provided in which the air purifier includes a flow passage forming unit accommodated in the housing space and communicating with the housing space and the outside, respectively, to form a flow passage through which external air flows to the air purification unit.

In addition, an air purifier may be provided in which the flow passage forming unit includes a purification support part that supports the air purification unit and has a purification flow passage formed therein communicating with the air purification unit; an opening/closing member that opens or closes the clean inlet part; and an opening/closing member support part that is continuous with the purification support part, is located adjacent to the clean inlet part, and includes a connection flow passage therein communicating with the purification flow passage, wherein the opening/closing member is rotatably coupled to the opening/closing member support part.

In addition, an air purifier may be provided in which the opening/closing member rotates about an axis parallel to an extension direction of the clean inlet part to open or close the clean inlet part.

In addition, an air purifier may be provided in which the flow passage forming unit includes an opening/closing member accommodation part that is formed open on one side of each side of the opening/closing member support part facing the clean inlet part, communicates the outside and the connection flow passage, and rotatably accommodates the opening/closing member.

In this case, an air purifier may be provided in which the flow passage forming unit includes a limiting protrusion protruding from the other side of each side of the opening/closing member support part opposite to the clean inlet part; and a limiting space formed inside the limiting protrusion, communicating with the connection flow passage, and partially accommodating the opening/closing member rotated to open the clean inlet part.

In addition, an air purifier may be provided in which the connection flow passage of the opening/closing member support part includes a first connection flow passage that communicates with an inner space of the opening/closing member support part and the dust inlet part, and forms a part of a flow passage in which external air introduced through the dust inlet part is directed to the air purification unit; and a second connection flow passage between the first connection flow passage and the dust inlet part, respectively communicating with the first connection flow passage and the dust inlet part, and forming a flow passage through which external air introduced into the dust inlet part flows into the first connection flow passage.

In this case, an air purifier may be provided in which the opening/closing member support part is composed of at least two extended parts that are continuous with each other and extend in different directions, the first connection flow passage is formed inside any one of the at least two extended parts, and the second connection flow passage is formed inside the other one of the at least two extended parts.

In addition, an air purifier may be provided in which the dust inlet part extends in the width direction of the housing, the second connection flow passage extends in one direction corresponding to the extension direction of the dust inlet part, and the first connection flow passage extends in the other direction at a predetermined angle with one end of the extension direction of the second connection flow passage.

In this case, an air purifier may be provided in which the flow passage forming unit includes a first connection flow passage extending in the height direction of the housing and communicating with the filter member; and a second connection flow passage communicating with the first connection flow passage, extending in the width direction of the housing, located adjacent to the dust inlet part, and communicating with the dust inlet part.

In addition, an air purifier may be provided in which at least some of foreign matters mixed with introduced external air falls on one surface of the inner surfaces of the flow passage forming unit surrounding the second connection flow passage from the lower side and is collected.

In this case, an air purifier may be provided in which the dust inlet part is formed through a lower end of one or more of the surfaces of the housing partially surrounding the housing space.

Advantageous Effects

According to the above configuration, the air purifier according to an embodiment of the present invention can remove dust remaining outside.

The air purifier includes a housing that forms its outer shape. A housing space communicating with the outside is formed inside the housing. The housing space accommodates an air purification unit that filters introduced air, and a flow passage forming unit that is coupled to the air purification unit and communicates with the air purification unit.

A dust inlet part is formed on any one of a plurality of surfaces surrounding the housing space. The dust inlet part is formed through the any one of the above surfaces and communicates the outside and the flow passage forming unit accommodated in the housing space. External air and dust, etc. mixed therewith may be introduced into the flow passage forming unit through the dust inlet part and flow toward the air purification unit.

In this case, the dust inlet part is located adjacent to one end in the height direction of the air purifier, that is, the lower end. In an embodiment, the dust inlet part may be formed to extend in the width direction of the air purifier, thereby increasing its cross-sectional area.

Therefore, dust, etc. remaining on the outer floor surface of the air purifier may be sucked into the air purifier along with the air. Accordingly, dust, etc. remaining outside the air purifier can be removed.

In addition, according to the above configuration, the air purifier according to an embodiment of the present invention can effectively remove dust remaining outside.

The air purifier includes a clean inlet part provided in the housing. The clean inlet part is located biased upward compared to the dust inlet part, and functions as a passage through which air remaining around the air purifier is introduced.

The flow passage forming unit includes an opening/closing member. The opening/closing member is located adjacent to the clean inlet part and is configured to open or close the clean inlet part. When the opening/closing member closes the clean inlet part, the conveying force applied by the fan member in the air purification unit is applied to the outside only through the dust inlet part.

That is, when the clean inlet part is closed, the conveying force applied by the fan member may be applied intensively to the air and dust, etc. remaining on the outer floor surface of the air purifier.

Therefore, dust, etc. remaining on the outer floor surface of the air purifier can receive a stronger suction force. Accordingly, dust, etc. remaining outside the air purifier can be effectively removed.

In addition, according to the above configuration, the air purifier according to an embodiment of the present invention can easily remove dust collected inside.

The dust inlet part is formed to extend along the width direction of the air purifier. In an embodiment, the dust inlet part may be formed in a shape sufficient to allow a nozzle such as a vacuum cleaner to pass through. Dust, etc. collected in the second connection flow passage of the flow passage forming unit communicating with the dust inlet part can be easily removed by a nozzle of an inserted vacuum cleaner, etc.

In an embodiment, the second connection flow passage may be partially surrounded by a drawer or tray. That is, dust, etc. collected in the second connection flow passage is seated in the drawer or tray. The drawer or tray is removably coupled to the housing, so that the drawer or tray can be separated and collected dust, etc. can be removed.

Therefore, dust, etc. collected inside the air purifier can be easily removed.

In addition, according to the above configuration, the air purifier according to an embodiment of the present invention can improve power efficiency.

As described above, the conveying force applied by a single fan member may be applied to the clean inlet part and the dust inlet part or only to the dust inlet part, depending on the open/closed state of the clean inlet part. That is, it is not required to have a plurality of fan members to suck air through a plurality of flow passages.

Therefore, both the air purification function and the external dust removal function can be performed with a single fan member, thereby improving power efficiency.

In addition, according to the above configuration, the air purifier according to an embodiment of the present invention can collect dust, etc. introduced with the air.

The flow passage forming unit includes a plurality of spaces in communication with the dust inlet part. Specifically, the flow passage forming unit includes a purification flow passage that communicates with the filter member, an arm flow passage that communicates with the purification flow passage, and an opening/closing member accommodation part that communicates with the arm flow passage and accommodates the opening/closing member.

In addition, the flow passage forming unit includes a first connection flow passage communicating with the opening/closing member accommodation part and a second connection flow passage communicating with the first connection flow passage. The second connection flow passage communicates with the outside through the dust inlet part.

In this case, the second connection flow passage extends in the width direction of the air purifier, and the first connection flow passage and the opening/closing member accommodation part extend in the height direction of the air purifier. That is, the flow passage through which air introduced through the dust inlet part and dust, etc. mixed therewith flows to the air purification unit is configured to include a portion extending in the up-down direction.

Therefore, dust, etc., which has a relatively large mass compared to air, cannot flow along the portion extending in the up-down direction and falls out due to its own weight. Likewise, dust, etc. that is introduced with air through the clean inlet part may also fall out through the portion extending in the up-down direction and be collected in the second connection flow passage.

Accordingly, dust, etc. introduced along with air can be effectively collected.

Advantageous effects of the present invention are not limited to the above-described effects, and should be understood to include all effects that can be inferred from the configuration of the invention described in the detailed description or claims of the present invention.

DETAILED DESCRIPTION OF THE EMBODIMENTS

Figure 1:
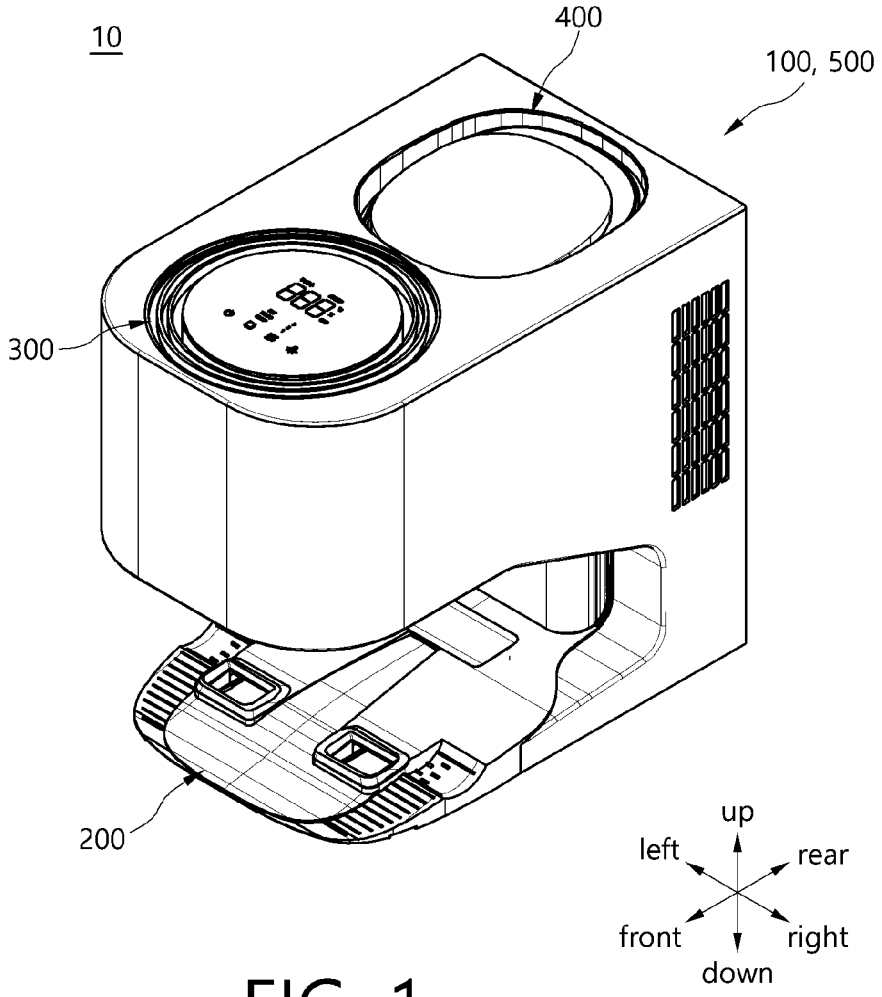
FIGS. 1 and 2 are perspective views illustrating an air purifier according to an embodiment of the present invention.
Figure 2:
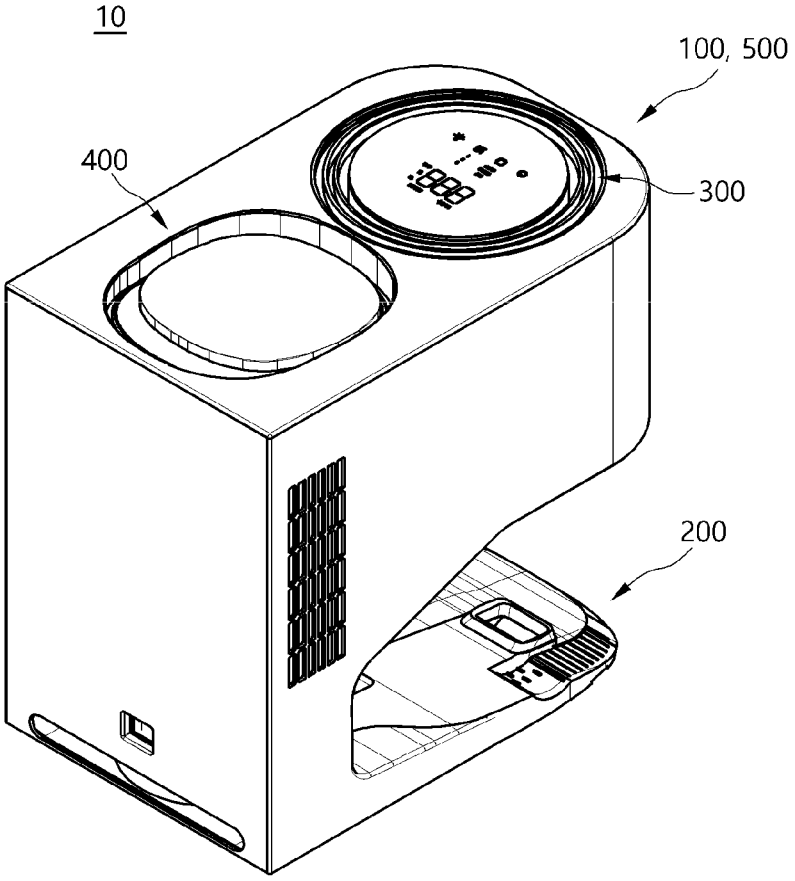
Figure 3:
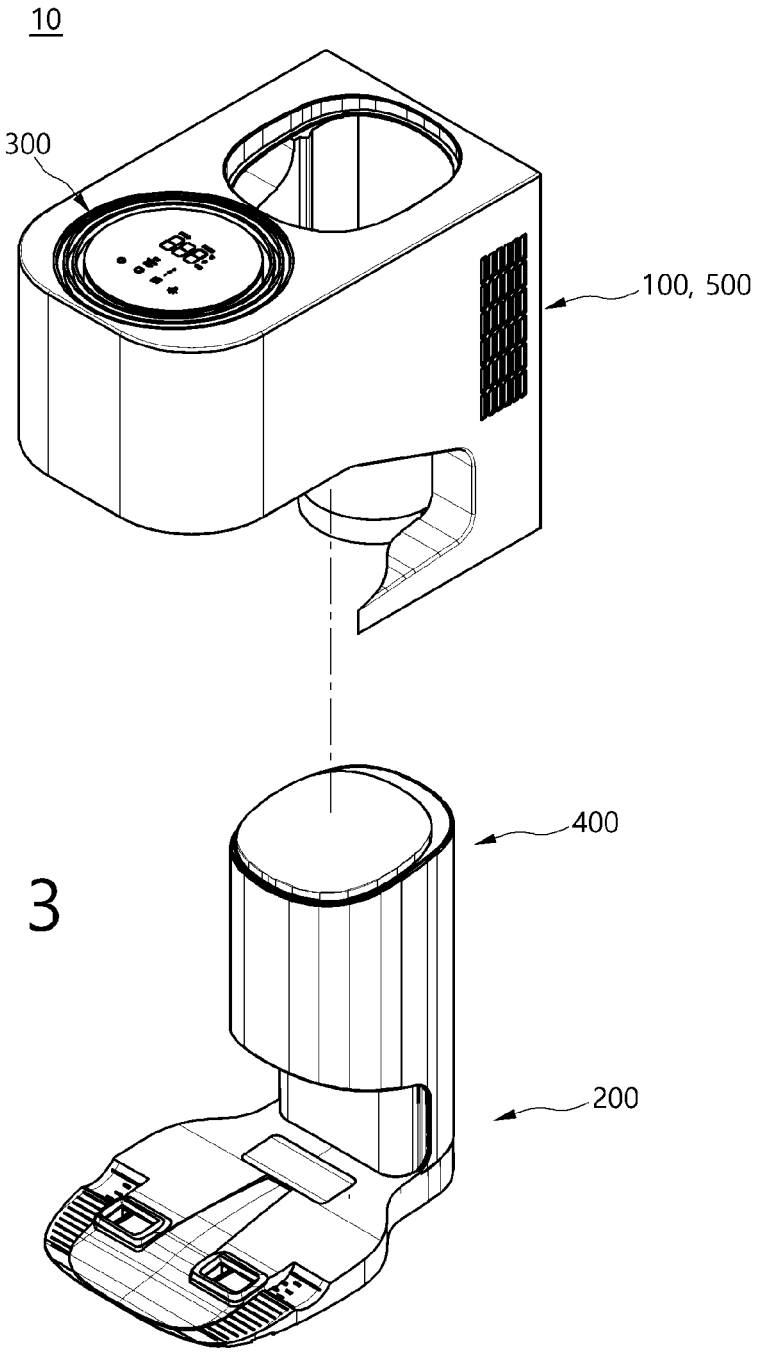
FIG. 3 is an exploded perspective view illustrating the configuration of the air purifier of FIG. 1.
Figure 4:
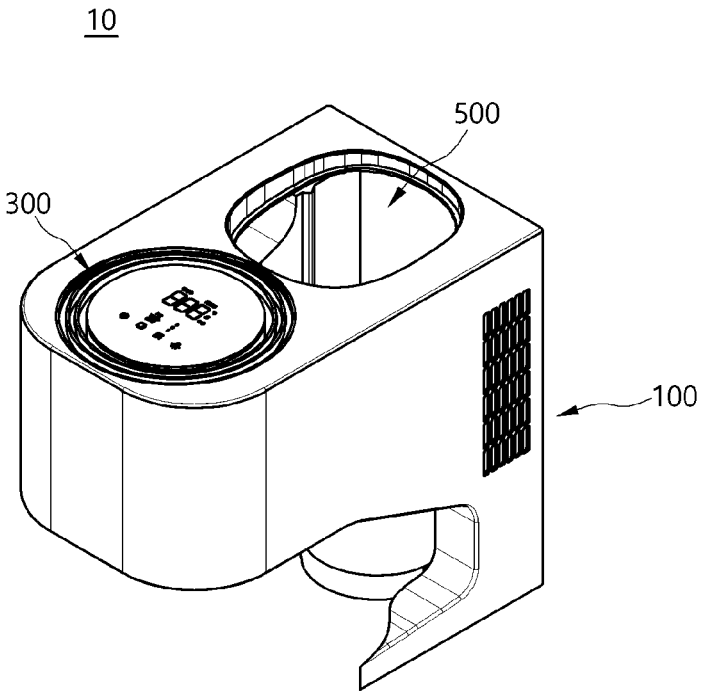
FIG. 4 is a perspective view illustrating a housing, an air purification unit, and a flow passage forming unit provided in the air purifier of FIG. 1.
Figure 5:
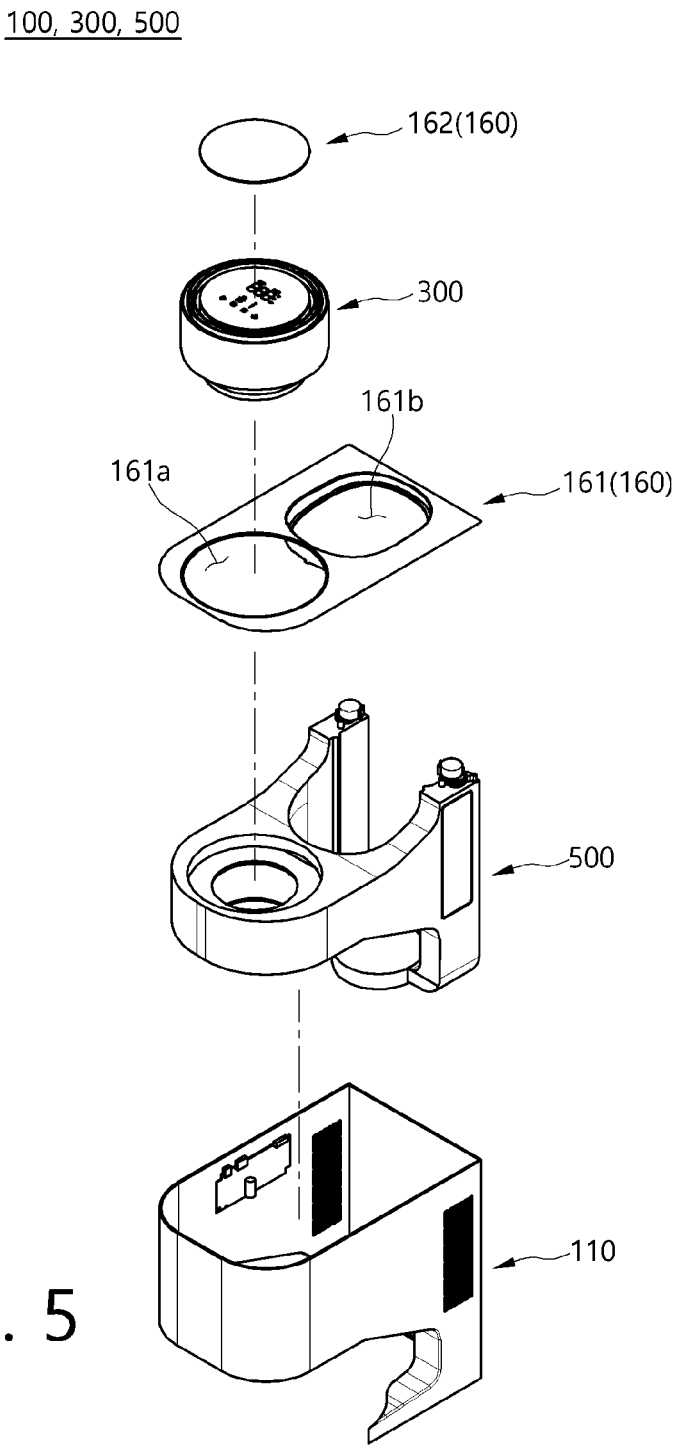
FIG. 5 is an exploded perspective view illustrating the coupling relationship between components of FIG. 4.
Figure 6:
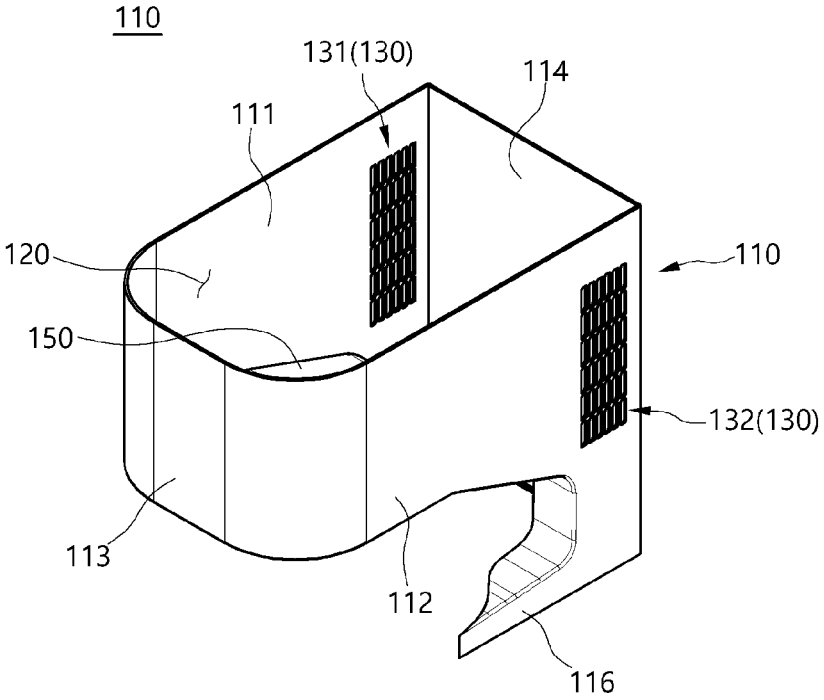
FIGS. 6 to 8 are perspective views illustrating the housing of FIG. 4.
Figure 7:
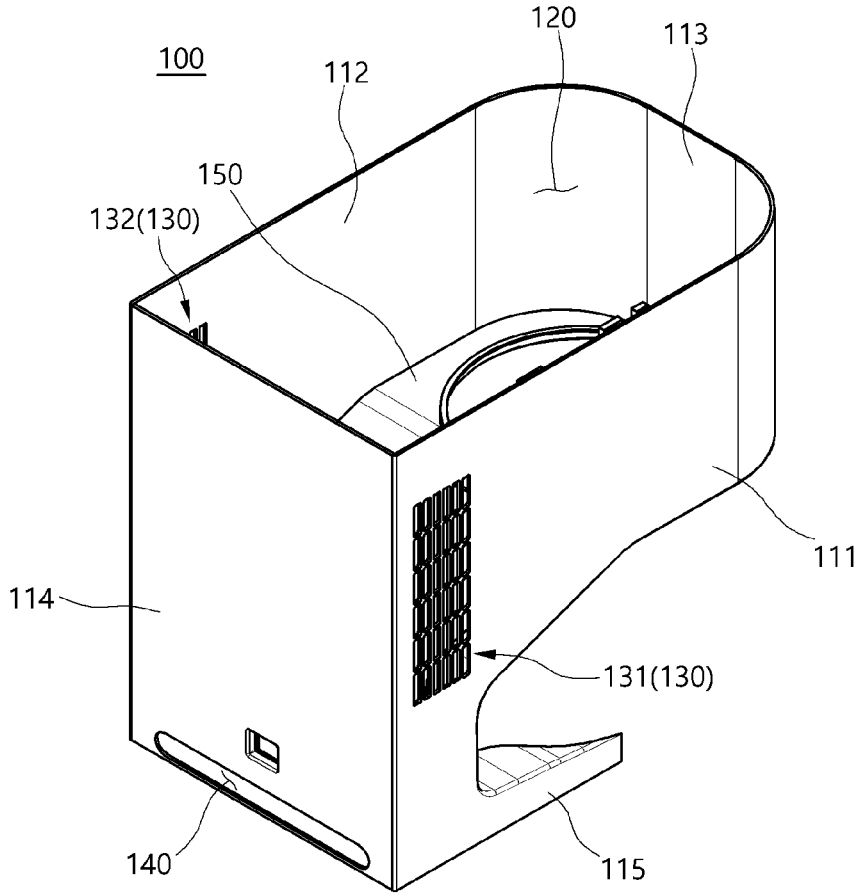
Figure 8:
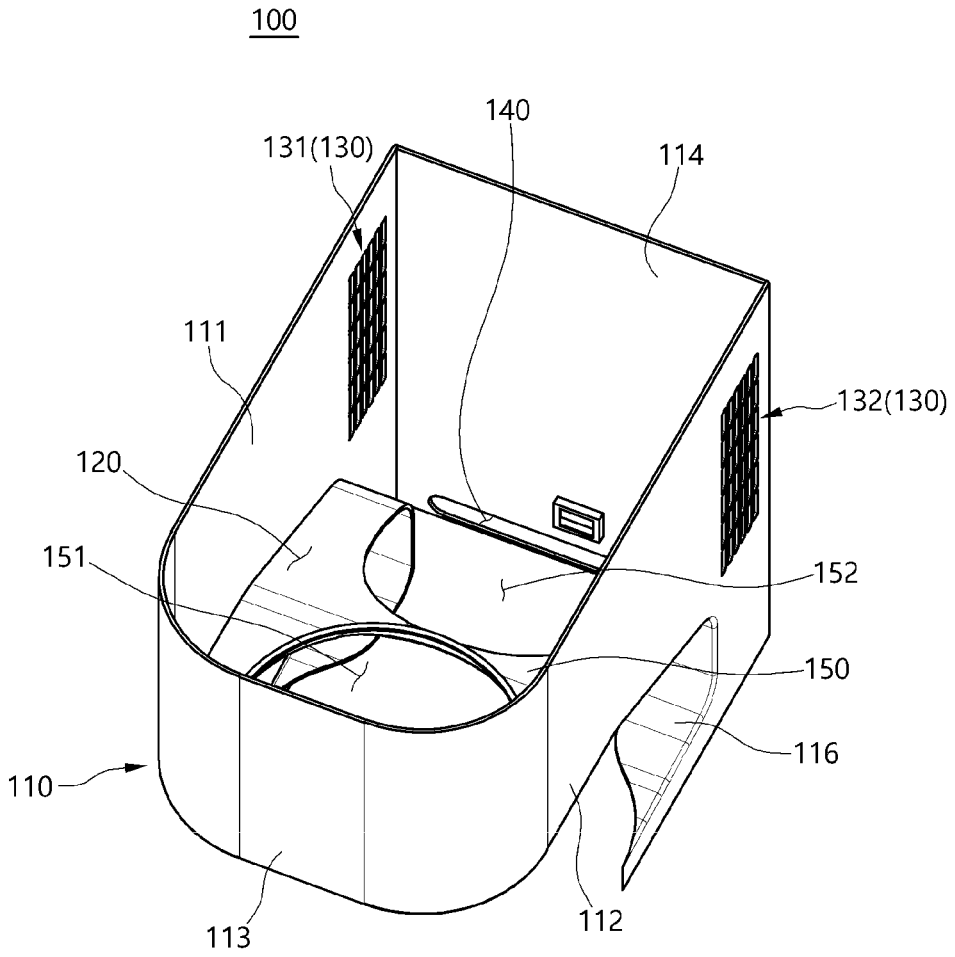

Hereinafter, exemplary embodiments of the present invention will be described in detail so that those of ordinary skill in the art can readily implement the present invention with reference to the accompanying drawings. The present invention may be embodied in many different forms and is not limited to the embodiments set forth herein. In the drawings, parts unrelated to the description are omitted for clarity of description of the present invention, and throughout the specification, same or similar reference numerals denote same elements.

Terms and words used in the present specification and claims should not be construed as limited to their usual or dictionary definition, and they should be interpreted as a meaning and concept consistent with the technical idea of the present invention based on the principle that inventors may appropriately define the terms and concept in order to describe their own invention in the best way.

Accordingly, the embodiments described in the present specification and the configurations shown in the drawings correspond to preferred embodiments of the present invention, and do not represent all the technical idea of the present invention, so the configurations may have various examples of equivalent and modification that can replace them at the time of filing the present invention.

In the following description, in order to clarify the features of the present invention, descriptions of some components may be omitted.

The term "communication" used in the following description means that one or more members are connected to each other so as to be in fluid communication. In an embodiment, communication may be formed by a member such as a conduit, a pipe, a tubing, or the like. In the following description, communication may be used in the same sense as one or more members are being "fluidically connected" to each other.

The term "energization" used in the following description means that one or more members are connected to each other so as to transmit a current or an electric signal. In an embodiment, the energization may be formed in a wired form by a wire member or the like or in a wireless form such as Bluetooth, Wi-Fi, RFID, or the like. In an embodiment, the energization may include the meaning of "communication".

The term "fluid" used in the following description refers to any form of material that flows by external force and whose shape or volume can be changed. In an embodiment, the fluid may be a liquid such as water or a gas such as air.

The term "dust, etc." used in the following description refers to microscopic particles that can be moved by the flow of fluid. In an embodiment, dust, etc. may be any material that can be collected by a robot vacuum cleaner (not shown), etc., or can flow with a fluid. In the following description, dust, etc. may be used to include fine-sized mote, hair, animal fur, etc.

The terms "upper side", "lower side", "left side", "right side", "front side", and "rear side" used in the following description will be understood with reference to the coordinate system shown in FIG. 1.

Referring to FIGS. 1 to 4, an air purifier 10 according to an embodiment of the present invention is shown. The air purifier 10 according to an embodiment of the present invention is in communication with the outside and can suck in outside air. The sucked air may pass through a component provided in the air purifier 10 (i.e., a filter member 350 to be described later), be filtered, and then be provided to the outside again.

In addition, the air purifier 10 according to an embodiment of the present invention can suck in dust, etc. remaining on the floor around the installation location. The sucked dust, etc. may flow along the flow passage formed inside the air purifier 10, but may be collected on the lower side of the inside of the air purifier 10 due to its weight.

In this case, the passage for the air purifier 10 to suck in dust, etc. remaining on the floor is located adjacent to the lower side of the air purifier 10 in the height direction. Therefore, dust, etc. sucked into the air purifier 10, that is, dust, etc. mixed with air, may be collected on the lower side of the inside of the air purifier 10, but the air introduced together may flow along a flow passage formed inside the air purifier 10 and may be filtered by the above one component and then provided to the outside again.

In addition, the air purifier 10 according to an embodiment of the present invention may be communicated with the outside through a plurality of flow passages. In this case, flow passages other than the flow passage for sucking dust, etc. as described above may be configured to be open and closed.

Therefore, the suction force applied to the flow passage for sucking dust, etc. may be adjusted by opening or closing the other flow passages. Accordingly, the air purifier 10 performs both the air purification function and the dust, etc. suction function, but is configured to intensively perform the dust, etc. suction function.

In the embodiments shown in FIGS. 1 to 4, the air purifier 10 includes a housing 100, a base 200, an air purification unit 300, a dust collection unit 400, and a flow passage forming unit 500.

The housing 100 forms part of the outer shape of the air purifier 10. A space is formed inside the housing 100 to accommodate a component of the air purifier 10.

The space of the housing 100 communicates with the outside. External air may flow along the flow passage forming unit 500 accommodated in the space of the housing 100 and be delivered to the air purification unit 300. The external air delivered to the air purification unit 300 may be purified and then discharged to the outside again.

In addition, dust, etc. that is introduced into the space of the housing 100 together with the air may be separated from the air by its own weight and remain in the space of the housing 100. The user can withdraw and remove dust, etc. remaining in the space.

The housing 100 is coupled to the base 200. The space of the housing 100 is partially surrounded by the base 200. In the illustrated embodiment, the lower side of the housing 100 is coupled to the base 200. The lower side of the space of the housing 100 may be surrounded by the base 200.

In an embodiment, the housing 100 and the base 200 may be integrally formed. In the above embodiment, it will be understood that the base 200 may be defined as the lower side part of the housing 100.

The housing 100 is coupled to the air purification unit 300. The air purification unit 300 communicates with the space of the housing 100. External air flowing into the space of the housing 100 may flow to the air purification unit 300, be purified, and then be discharged to the outside. In the illustrated embodiment, the upper side of the housing 100 is coupled to air purification unit 300.

The housing 100 is coupled to the dust collection unit 400. The dust collection unit 400 may have a space formed therein to accommodate dust, etc. In an embodiment in which the air purifier 10 is configured to perform the function of a robot vacuum cleaner station, the dust collection unit 400 can receive and accommodate dust, etc. collected by a robot vacuum cleaner (not shown). The housing 100 partially accommodates the dust collection unit 400.

The housing 100 is coupled to the flow passage forming unit 500. Specifically, the flow passage forming unit 500 is accommodated in the space of the housing 100. The flow passage forming unit 500 is configured to form a flow passage through which external air is introduced into the air purification unit 300.

In the embodiments illustrated in FIGS. 5 to 8, the housing 100 includes a housing body 110, a housing space 120, a clean inlet part 130, a dust inlet part 140, a support rib 150, and a housing cover 160.

The housing body 110 forms a body of the housing 100. The housing body 110 is supported by being coupled to the base 200. The housing body 110 is coupled to the air purification unit 300 and the dust collection unit 400 and supports them.

The housing body 110 partially surrounds the housing space 120. A through hole is formed in a portion of the housing body 110 so that the housing space 120 can communicate with the outside. The housing body 110 supports the flow passage forming unit 500 accommodated in the housing space 120.

The housing body 110 may be of any shape that can be coupled with the base 200, the air purification unit 300, the dust collection unit 400, and the flow passage forming unit 500. In the illustrated embodiment, the housing body 110 is formed to have a width in the left-right direction that is longer than a length in the front-rear direction and a height in the up-down direction.

In the illustrated embodiment, the housing body 110 includes a first housing surface 111, a second housing surface 112, a third housing surface 113, a fourth housing surface 114, a first rack 115, and a second rack 116.

The first housing surface 111 forms one surface of the housing body 110. The first housing surface 111 extends to surround the housing space 120 from one side. In the illustrated embodiment, the first housing surface 111 forms a left side surface of the housing body 110. The first housing surface 111 surrounds the housing space 120 from the left side.

The first housing surface 111 is arranged to face the second housing surface 112 with the housing space 120 interposed therebetween. In an embodiment, the first housing surface 111 may extend parallel to the second housing surface 112.

The first housing surface 111 is continuous with the third housing surface 113. In the illustrated embodiment, one end in the longitudinal direction, that is, the front end, of the first housing surface 111 is continuous with one end in the width direction, that is, the left end, of the third housing surface 113.

The first housing surface 111 is continuous with the fourth housing surface 114. In the illustrated embodiment, the other end in the longitudinal direction, that is, the rear end, of the first housing surface 111 is continuous with one end in the width direction, that is, the left end, of the fourth housing surface 114.

The first housing surface 111 is continuous with the first rack 115. In the illustrated embodiment, one end in the height direction, that is, the lower end, of the first housing surface 111 is continuous with the first rack 115.

A first clean inlet part 131 is formed on the first housing surface 111. In the illustrated embodiment, the first clean inlet part 131 is located biased on the other side, that is, the rear side, facing the fourth housing surface 114.

The first housing surface 111 is continuous with the third housing surface 113, the fourth housing surface 114, and the first rack 115, and may have any shape that can at least partially surround the housing space 120. In the illustrated embodiment, the first housing surface 111 is provided in a plate shape with a length in the front-rear direction, a height in the up-down direction, and a thickness in the left-right direction.

The second housing surface 112 forms the other surface of the housing body 110. The second housing surface 112 extends to surround the housing space 120 from the other side. In the illustrated embodiment, the second housing surface 112 forms a right side surface of the housing body 110. The second housing surface 112 surrounds the housing space 120 from the right side.

The second housing surface 112 is arranged to face the first housing surface 111 with the housing space 120 interposed therebetween. In an embodiment, as described above, the second housing surface 112 may extend parallel to the first housing surface 111.

The second housing surface 112 is continuous with the third housing surface 113. In the illustrated embodiment, one end in the longitudinal direction, that is, the front end, of the second housing surface 112 is continuous with the other end in the width direction, that is, the right end, of the third housing surface 113.

The second housing surface 112 is continuous with the fourth housing surface 114. In the illustrated embodiment, the other end in the longitudinal direction, that is, the rear end, of the second housing surface 112 is continuous with the other end in the width direction, that is, the right end, of the fourth housing surface 114.

The second housing surface 112 is continuous with the second rack 116. In the illustrated embodiment, one end in the height direction, that is, the lower end, of the second housing surface 112 is continuous with the second rack 116.

A second clean inlet part 132 is formed on the second housing surface 112. In the illustrated embodiment, the second clean inlet part 132 is located biased on the other side, that is, the rear side, facing the fourth housing surface 114.

The second housing surface 112 is continuous with the third housing surface 113, the fourth housing surface 114, and the second rack 116, and may have any shape that can at least partially surround the housing space 120. In the illustrated embodiment, the second housing surface 112 is provided in a plate shape with a length in the front-rear direction, a height in the up-down direction, and a thickness in the left-right direction.

The third housing surface 113 forms another surface of the housing body 110. The third housing surface 113 extends to surround the housing space 120 from the another side. In the illustrated embodiment, the third housing surface 113 forms a front side surface of the housing body 110. The third housing surface 113 surrounds the housing space 120 from the front side.

The third housing surface 113 is arranged to face the fourth housing surface 114 with the housing space 120 interposed therebetween.

The third housing surface 113 is continuous with the first housing surface 111 and the second housing surface 112. The third housing surface 113 extends between the first housing surface 111 and the second housing surface 112.

The third housing surface 113 is continuous with the first and second housing surfaces 111 and 112, respectively, and may have any shape that can at least partially surround the housing space 120. In the illustrated embodiment, the third housing surface 113 has a curved shape that is rounded and convex toward the outside. The third housing surface 113 may be changed to correspond to the shape of the air purification unit 300.

The fourth housing surface 114 forms yet another surface of the housing body 110. The fourth housing surface 114 extends to surround the housing space 120 from the yet another side. In the illustrated embodiment, the fourth housing surface 114 forms a rear side surface of the housing body 110. The fourth housing surface 114 surrounds the housing space 120 from the rear side.

The fourth housing surface 114 is arranged to face the third housing surface 113 with the housing space 120 interposed therebetween.

The fourth housing surface 114 is continuous with the first housing surface 111 and the second housing surface 112. The fourth housing surface 114 extends between the first housing surface 111 and the second housing surface 112.

The fourth housing surface 114 is continuous with the first and second housing surfaces 111 and 112, respectively, and may have any shape that can at least partially surround the housing space 120. In the illustrated embodiment, the fourth housing surface 114 is provided in a plate shape with a width in the left-right direction, a length in the up-down direction, and a thickness in the front-rear direction.

A dust inlet part 140 may be formed at one end of the height direction of the fourth housing surface 114 facing the floor surface, that is, at a position adjacent to the lower end in the illustrated embodiment.

The first rack 115 and the second rack 116 are parts where the housing body 110 is coupled to the base 200. The first rack 115 and the second rack 116 each form the lower side of the housing body 110. The first rack 115 and the second rack 116 are arranged to be spaced apart from each other in the width direction of the housing body 110, that is, in the left-right direction in the illustrated embodiment.

The first rack 115 is continuous with the first housing surface 111 located on the left side. The first rack 115 may be configured to support the left portion of the housing body 110.

The second rack 116 is continuous with the second housing surface 112 located on the right side. The second rack 116 may be configured to support the right portion of the housing body 110.

The housing space 120 is a space formed inside the housing body 110. The housing space 120 is surrounded and defined by the housing body 110. As described above, the housing space 120 may be defined as being partially surrounded by the first to fourth housing surfaces 111, 112, 113, and 114, respectively.

The housing space 120 communicates with the outside. In the illustrated embodiment, one side of the housing space 120 in the height direction, that is, the upper side, is formed open. The air purification unit 300 and the flow passage forming unit 500 may be accommodated in the housing space 120 or withdrawn from the housing space 120 through the one side, that is, the upper side, of the housing space 120.

The other side in the height direction of the housing space 120, that is, the lower side in the illustrated embodiment, is also formed open. In this case, the lower side of the housing space 120 may be partially closed by the support rib 150. The air purification unit 300 and the dust collection unit 400 may be supported by the support rib 150 and may not be separated to the lower side of the housing space 120.

One side in the width direction of the housing space 120, that is, the left side in the illustrated embodiment, communicates with the outside. Specifically, one side of the housing space 120 in the width direction communicates with the outside through the first clean inlet part 131. External air to be purified may flow into the housing space 120 through the first clean inlet part 131 to the one side. As will be described later, an opening/closing member 560 of the flow passage forming unit 500 is located in the first clean inlet part 131 to open or close the first clean inlet part 131.

Accordingly, it can be said that the housing space 120 selectively communicates with the outside through the one side by the opening/closing member 560.

The other side in the width direction of the housing space 120, that is, the right side in the illustrated embodiment, communicates with the outside. Specifically, the other side of the housing space 120 in the width direction communicates with the outside through the second clean inlet part 132. External air to be purified may flow into the housing space 120 through the second clean inlet part 132 to the other side. As will be described later, an opening/closing member 560 of the flow passage forming unit 500 is also located in the second clean inlet part 132 to open or close the second clean inlet part 132.

Accordingly, it can be said that the housing space 120 selectively communicates with the outside through the other side by the opening/closing member 560.

One side in the longitudinal direction of the housing space 120, that is, the rear lower side in the illustrated embodiment, communicates with the outside. Specifically, the housing space 120 may communicate with the outside through the dust inlet part 140 formed on the fourth housing surface 114.

The housing space 120 may be partially closed on one side in the height direction, or in the illustrated embodiment, on the lower side, by the base 200. The housing space 120 may accommodate the air purification unit 300 in a withdrawable manner. In the illustrated embodiment, the air purification unit 300 is located biased on one side in the longitudinal direction of the housing space 120, that is, biased toward the front side in the illustrated embodiment. The housing space 120 communicates with the air purification unit 300.

The housing space 120 may accommodate the dust collection unit 400 in a withdrawable manner. The dust collection unit 400 is located biased on the other side in the longitudinal direction of the housing space 120, that is, on the rear side in the illustrated embodiment. The housing space 120 communicates with the dust collection unit 400.

The housing space 120 accommodates the flow passage forming unit 500. The flow passage forming unit 500 communicates with the air purification unit 300 accommodated in the housing space 120.

The clean inlet part 130 functions as a passage through which external air to be purified is introduced. The clean inlet part 130 is formed through one or more of the plurality of housing surfaces 111, 112, 113, and 114 surrounding the housing space 120. The clean inlet part 130 communicates the housing space 120 and the outside.

The clean inlet part 130 communicates with the opening/closing member accommodation part 540 of the flow passage forming unit 500 accommodated in the housing space 120. Specifically, the clean inlet part 130 is located adjacent to the opening/closing member 560 and can be opened or closed by the opening/closing member 560. Therefore, it can be said that the clean inlet part 130 selectively communicates the outside and the opening/closing member accommodation part 540.

When the opening/closing member 560 closes the clean inlet part 130, external air can only flow in through the dust inlet part 140, which will be described later. Accordingly, when the clean inlet part 130 is closed, the flow rate of air flowing in through the dust inlet part 140 may increase. Accordingly, the amount of inflow of dust, etc. remaining on the outside of the air purifier 10 and air mixed therewith may increase.

When the opening/closing member 560 opens the clean inlet part 130, external air can flow in through both the clean inlet part 130 and the dust inlet part 140. Assuming that a fan member 320 of the air purification unit 300 operates at the same speed, the flow rate of air flowing in through the dust inlet part 140 can be reduced compared to the case where the clean inlet part 130 is closed.

On the other hand, since air is also introduced through the clean inlet part 130 located closer to the air purification unit 300, is filtered, and then discharged, the air purification speed can proceed faster.

Therefore, the air purifier 10 according to an embodiment of the present invention performs various functions, but can perform one function more prominently by manipulating the opening/closing member 560. This will be described later in detail.

The clean inlet part 130 may be provided in any shape capable of communicating the outside and the housing space 120 (and the flow passage forming unit 500 accommodated in the housing space 120). In the illustrated embodiment, the clean inlet part 130 is provided with a plurality of through holes penetrating through one or more of the housing surfaces 111, 112, 113, and 114.

A plurality of clean inlet parts 130 may be provided. The plurality of clean inlet parts 130 may be spaced apart from each other in the longitudinal direction and height direction of the housing body 110, respectively. In the illustrated embodiment, the plurality of clean inlet parts 130 are arranged to be spaced apart in the front-rear direction and up-down direction, respectively.

In this case, the separation distance between the pair of clean inlet parts 130 located at each end along the front-rear direction may be less than or equal to the length of an opening/closing body 561, that is, the length in the front-rear direction. In addition, the separation distance between the pair of clean inlet parts 130 located at each end along the up-down direction may be less than or equal to the height of the opening/closing body 561, that is, the length in the up-down direction.

Therefore, the plurality of clean inlet parts 130 may all be closed or opened by the opening/closing member 560.

The clean inlet part 130 may be provided on a plurality of housing surfaces 111, 112, 113, and 114. The clean inlet parts 130 provided on the plurality of housing surfaces 111, 112, 113, and 114 may communicate the outside and the housing space 120 (and the flow passage forming unit 500 accommodated in the housing space 120), respectively. In the illustrated embodiment, the clean inlet part 130 includes a first clean inlet part 131 and a second clean inlet part 132.

The first clean inlet part 131 is formed on the first housing surface 111. The first clean inlet part 131 is located biased on one side toward the fourth housing surface 114 in the longitudinal direction of the first housing surface 111, that is, on the rear side in the illustrated embodiment.

The second clean inlet part 132 is formed on the second housing surface 112. The second clean inlet part 132 is located biased on one side toward the fourth housing surface 114 in the longitudinal direction of the second housing surface 112, that is, on the rear side in the illustrated embodiment.

The first clean inlet part 131 and the second clean inlet part 132 are arranged to face each other with the housing space 120 interposed therebetween.

As will be described later, the first clean inlet part 131 and the second clean inlet part 132 may be opened or closed independently of each other. This can be achieved by controlling a pair of opening/closing members 560 located adjacent to the first and second clean inlet parts 131 and 132, respectively, independently of each other.

The illustrated embodiment assumes that a pair of clean inlet parts 130 are provided and formed on the first and second housing surfaces 111 and 112, respectively. Alternatively, the clean inlet part 130 may be provided in a single or plural number and formed on any one of a plurality of housing surfaces 111, 112, 113, and 114. In another embodiment, the clean inlet part 130 may be provided in a plural number and formed on one or more of a plurality of housing surfaces 111, 112, 113, and 114.

The dust inlet part 140 forms a passage through which air remaining on the outer floor surface of the air purifier 10 is introduced into the interior of the air purifier 10. The dust inlet part 140 communicates the housing space 120 and the outside. The dust inlet part 140 is formed through any one of the housing surfaces 111, 112, 113, and 114 surrounding the housing space 120.

The dust inlet part 140 may be provided in any shape capable of communicating the outside and the housing space 120 (and the flow passage forming unit 500 accommodated in the housing space 120). In the illustrated embodiment, the dust inlet part 140 is formed as a through hole with a cross-section in which the extension length in one direction is longer than the extension length in the height direction.

The dust inlet part 140 may be formed on one or more of a plurality of housing surfaces 111, 112, 113, and 114. In the illustrated embodiment, the dust inlet part 140 is formed through the fourth housing surface 114 surrounding the housing space 120 from the rear side, in the thickness direction, that is, in the front-rear direction.

Therefore, based on the housing body 110, the dust inlet part 140 may be defined as a space in which the length of the housing body 110 in the width direction is longer than the length of the housing body 110 in the height direction and the space has a thickness in the longitudinal direction of the housing body 110.

The dust inlet part 140 is located biased in a direction toward the base 200 among the height direction ends of the fourth housing surface 114, that is, at the lower end in the illustrated embodiment. It is preferable that the dust inlet part 140 is located as biased as possible toward the end, that is, the lower end, in the height direction of the fourth housing surface 114.

In the above embodiment, dust, etc. remaining on the outer floor surface of the air purifier 10 can more smoothly flow into the housing space 120 through the dust inlet part 140.

The illustrated embodiment assumes that a single dust inlet part 140 is formed on the fourth housing surface 114. Alternatively, the dust inlet part 140 may be provided in a single or plural number and formed on any one of a plurality of housing surfaces 111, 112, 113, and 114. In another embodiment, the dust inlet part 140 may be provided in a plural number and formed on one or more of a plurality of housing surfaces 111, 112, 113, and 114.

In any case, it is sufficient that the dust inlet part 140 is located as close to the lower end of the housing body 110 as possible so that dust, etc. remaining on the outer floor surface of the air purifier 10 can smoothly flow into the housing space 120.

The support rib 150 supports the air purification unit 300 and the dust collection unit 400 accommodated in the housing space 120. The support rib 150 is accommodated in the housing space 120. The support rib 150 may be configured to extend in the width direction of the housing space 120, that is, in the left-right direction in the illustrated embodiment, to reinforce the rigidity of the housing body 110.

The support rib 150 may extend in one direction between a pair of surfaces arranged to face each other with the housing space 120 interposed therebetween. In the illustrated embodiment, the support rib 150 extends between the first housing surface 111 and the second housing surface 112.

The support rib 150 is continuous with the surface surrounding the housing space 120 in the other direction. In the illustrated embodiment, the support rib 150 is continuous with the third housing surface 113 surrounding the housing space 120 from the front side.

The support rib 150 supports the flow passage forming unit 500 accommodated in the housing space 120. The flow passage forming unit 500 is prevented from randomly swinging or deviating from the housing space 120 due to the support rib 150. Accordingly, the flow passage forming unit 500 can be stably maintained in communication with the clean inlet part 130, the dust inlet part 140, and the air purification unit 300.

The support rib 150 may include a plurality of through holes. The through hole may penetrate in the height direction of the housing body 110, that is, in the up-down direction in the illustrated embodiment. The air purification unit 300 is coupled to one of the plurality of through holes. The dust collection unit 400 is coupled to another one of the plurality of through holes.

In the illustrated embodiment, the support rib 150 includes a purification coupling hole 151 and a collection coupling hole 152.

The purification coupling hole 151 accommodates the air purification unit 300. The purification coupling hole 151 is located biased on one side in the longitudinal direction of the support rib 150, that is, on the front side in the illustrated embodiment. The air purification unit 300 accommodated in the purification coupling hole 151 may be supported by the one side, that is, the front side portion, of the support rib 150.

The collection coupling hole 152 accommodates the dust collection unit 400. Compared to the purification coupling hole 151, the collection coupling hole 152 is located biased on the other side in the longitudinal direction of the support rib 150, that is, on the rear side in the illustrated embodiment. The dust collection unit 400 accommodated in the collection coupling hole 152 may be supported by the other side, that is, the rear side portion, of the support rib 150.

The shapes of the purification coupling hole 151 and the collection coupling hole 152 may be formed to correspond to the shapes of the air purification unit 300 and the dust collection unit 400, respectively. In the illustrated embodiment, the purification coupling hole 151 is formed to have a circular cross-section and a height in the up-down direction. In addition, the collection coupling hole 152 is formed to have a circular shape on its front side, but open on its rear side.

The housing cover 160 covers the housing space 120 and is coupled to the housing body 110. In an embodiment, the housing cover 160 is detachably coupled to the housing body 110. The housing cover 160 is coupled to one side in the height direction of the housing body 110, that is, the upper side in the illustrated embodiment.

A plurality of housing covers 160 may be provided. The plurality of housing covers 160 may be stacked in the height direction of the housing body 110, that is, in the up-down direction in the illustrated embodiment, and may be respectively coupled to the housing body 110.

In the illustrated embodiment, the housing cover 160 includes a first housing cover 161 and a second housing cover 162.

The first housing cover 161 is directly coupled to the housing body 110 among the plurality of housing covers 160. The first housing cover 161 may have a shape corresponding to the cross-section in the horizontal direction of the housing space 120. In the illustrated embodiment, the first housing cover 161 is provided in a polygonal plate shape to have a front edge that is curved, other edges that are flat, and a thickness in the up-down direction, like the horizontal cross-sectional shape of the first to fourth housing surfaces 111, 112, 113, and 114.

The air purification unit 300 and the dust collection unit 400 may penetrate the first housing cover 161. In the illustrated embodiment, the first housing cover 161 includes a first cover coupling hole 161*a* and a second cover coupling hole 161*b*.

The first cover coupling hole 161*a* is a portion through which the air purification unit 300 penetrates. The first cover coupling hole 161*a* is formed through the first housing cover 161 in the thickness direction, that is, in the up-down direction in the illustrated embodiment.

The first cover coupling hole 161*a* may be arranged to overlap the purification coupling hole 151 along the height direction of the housing body 110. In the illustrated embodiment, the first cover coupling hole 161*a* is located biased on one side in the longitudinal direction of the first housing cover 161, that is, on the front side.

The second cover coupling hole 161*b* is a portion through which the dust collection unit 400 penetrates. The second cover coupling hole 161*b* is formed through the first housing cover 161 in the thickness direction, that is, in the up-down direction in the illustrated embodiment.

The second cover coupling hole 161*b* may be arranged to overlap the collection coupling hole 152 along the height direction of the housing body 110. In the illustrated embodiment, the second cover coupling hole 161*b* is located biased on the other side in the longitudinal direction of the first housing cover 161, that is, on the rear side.

The second housing cover 162 covers one side in the height direction of the air purification unit 300 coupled to the first housing cover 161, that is, the upper side in the illustrated embodiment, and is coupled to the housing body 110. The second housing cover 162 is located on one side biased toward the first cover coupling hole 161*a*, that is, toward the front side in the illustrated embodiment.

The second housing cover 162 may have a shape corresponding to the one side, that is, the upper side, of the air purification unit 300. In the illustrated embodiment, the second housing cover 162 has a disc shape having a circular cross-section and having a thickness in the up-down direction.

In an embodiment, the second housing cover 162 may not be provided. That is, in the above embodiment, only the first housing cover 161 may be provided to cover the housing space 120 and support the air purification unit 300 and the dust collection unit 400.

The base 200 forms another part of the exterior of the air purifier 10. The base 200 is coupled to the housing 100 and supports the housing 100. In the illustrated embodiment, the base 200 is coupled to the first rack 115 and the second rack 116 constituting the lower side of the housing body 110.

The base 200 surrounds the housing space 120 from one side in the height direction, that is, from the lower side in the illustrated embodiment. The lower side of the housing space 120 may be sealed by the base 200.

The base 200 may be coupled to the housing 100 to support the housing 100 and may have any shape capable of surrounding the housing space 120. In the illustrated embodiment, the base 200 is configured to include a top surface that extends obliquely so that its height increases toward the rear side in the longitudinal direction of the housing 100. In the above embodiment, the base 200 may be configured to seat a robot vacuum cleaner (not shown).

The air purification unit 300 performs the function of filtering air introduced from the outside. The air purification unit 300 is in communication with the housing space 120, so that air flowing into the housing space 120 can be introduced thereto. The air purification unit 300 is in communication with the outside, so that the filtered air can be discharged out to the outside therefrom.

The air purification unit 300 is coupled to the housing 100. Specifically, the air purification unit 300 is inserted and coupled to the purification coupling hole 151 of the support rib 150 located in the housing space 120. The air purification unit 300 is at least partially accommodated in the housing space 120. The air purification unit 300 may be supported by the support rib 150.

The air purification unit 300 may be removably coupled to the housing 100. When maintenance of the air purification unit 300 is required, the user can remove the air purification unit 300 from the housing 100.

The air purification unit 300 communicates with the housing space 120. Accordingly, the air purification unit 300 may be accommodated in the housing space 120 and communicate with the flow passage forming unit 500 that communicates with the housing space 120. External air flowing along the flow passage forming unit 500 may flow into the air purification unit 300.

The air purification unit 300 is coupled to the flow passage forming unit 500. The air purification unit 300 is removably accommodated in a purification accommodation part 511 provided in the flow passage forming unit 500. The air purification unit 300 may be supported by a purification support part 510.

The air purification unit 300 may be provided in any form that communicates with the outside and the housing space 120 (or the flow passage forming unit 500 accommodated in the housing space 120), and can receive external air, filter it, and discharge it again.

Figure 9:
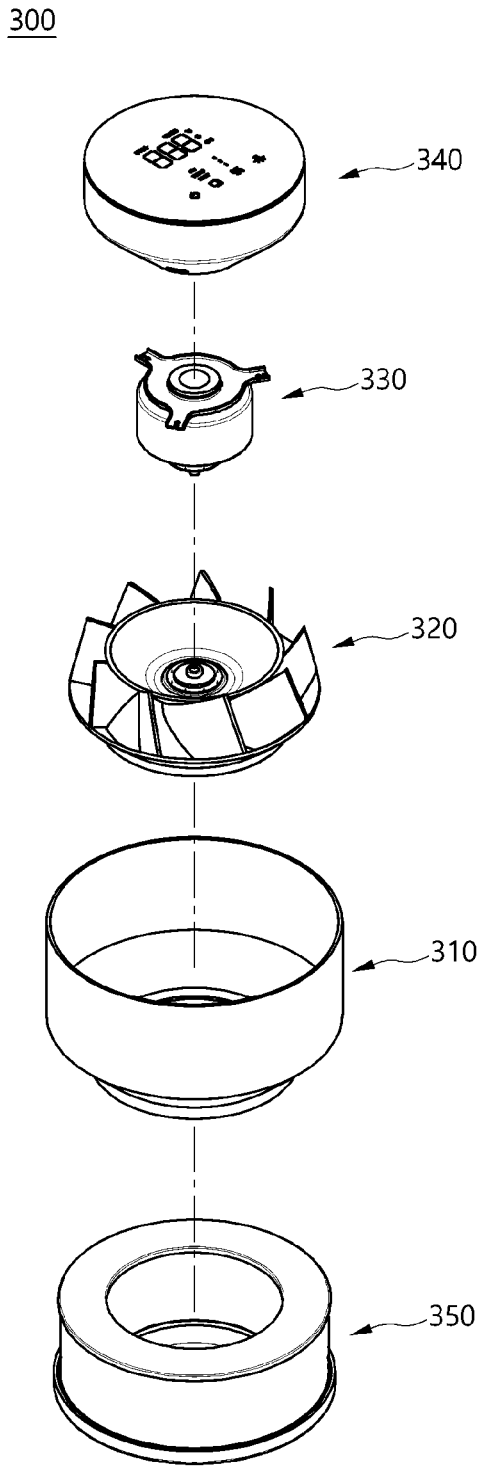
FIG. 9 is an exploded perspective view illustrating the configuration of the air purification unit of FIG. 4.
Figure 10:
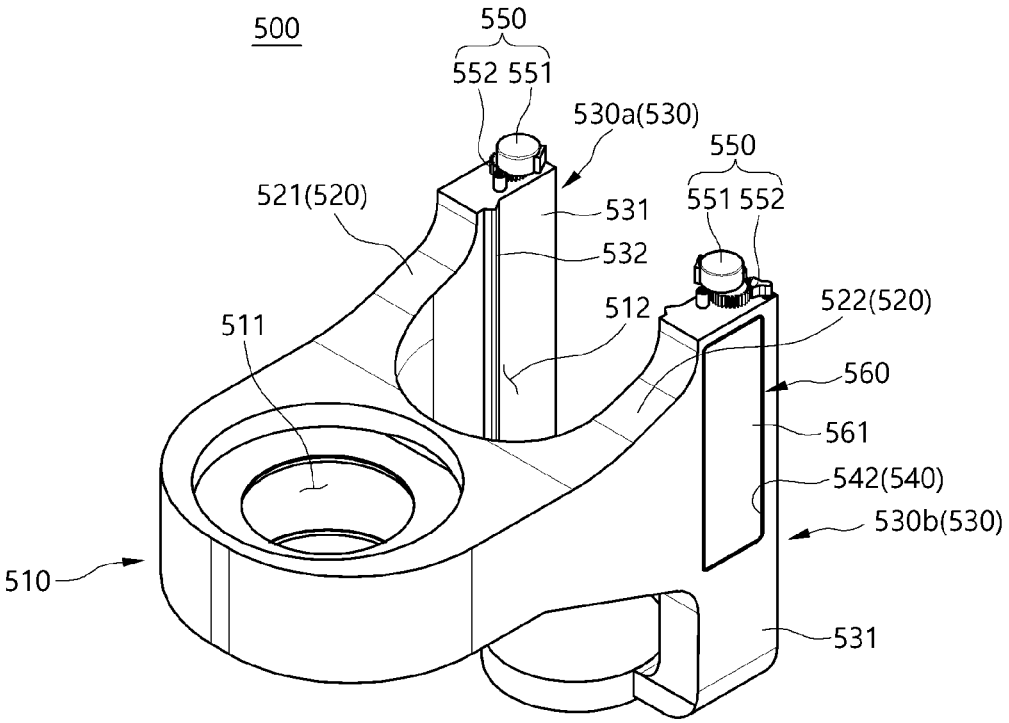
FIG. 10 is a perspective view illustrating the flow passage forming unit of FIG. 4.
Figure 11:
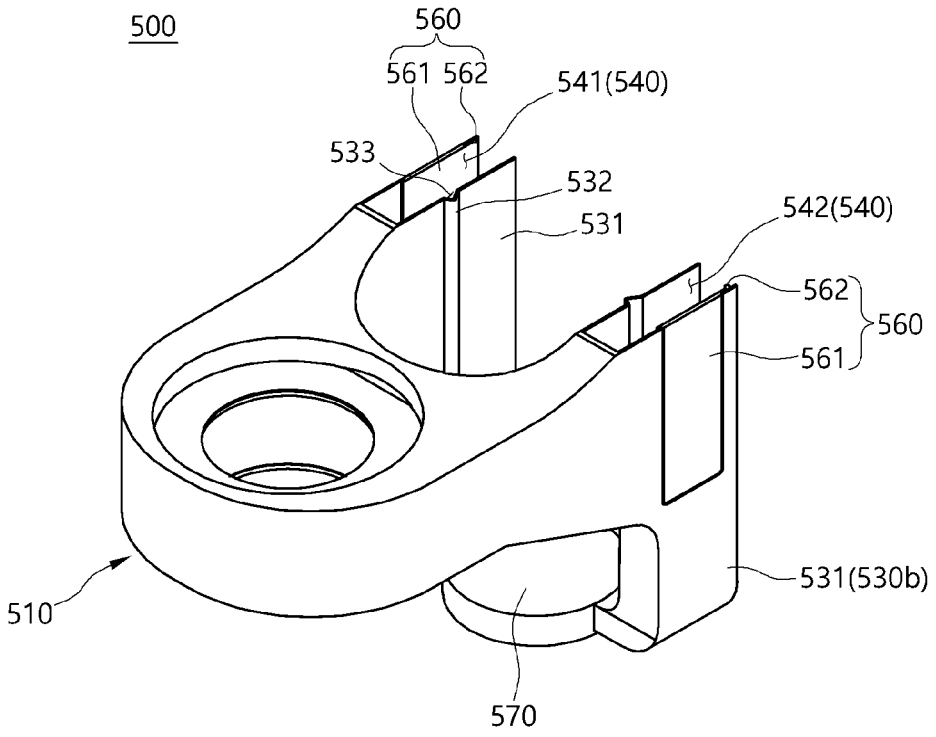
FIG. 11 is a cross-sectional perspective view illustrating the flow passage forming unit of FIG. 10.
Figure 12:
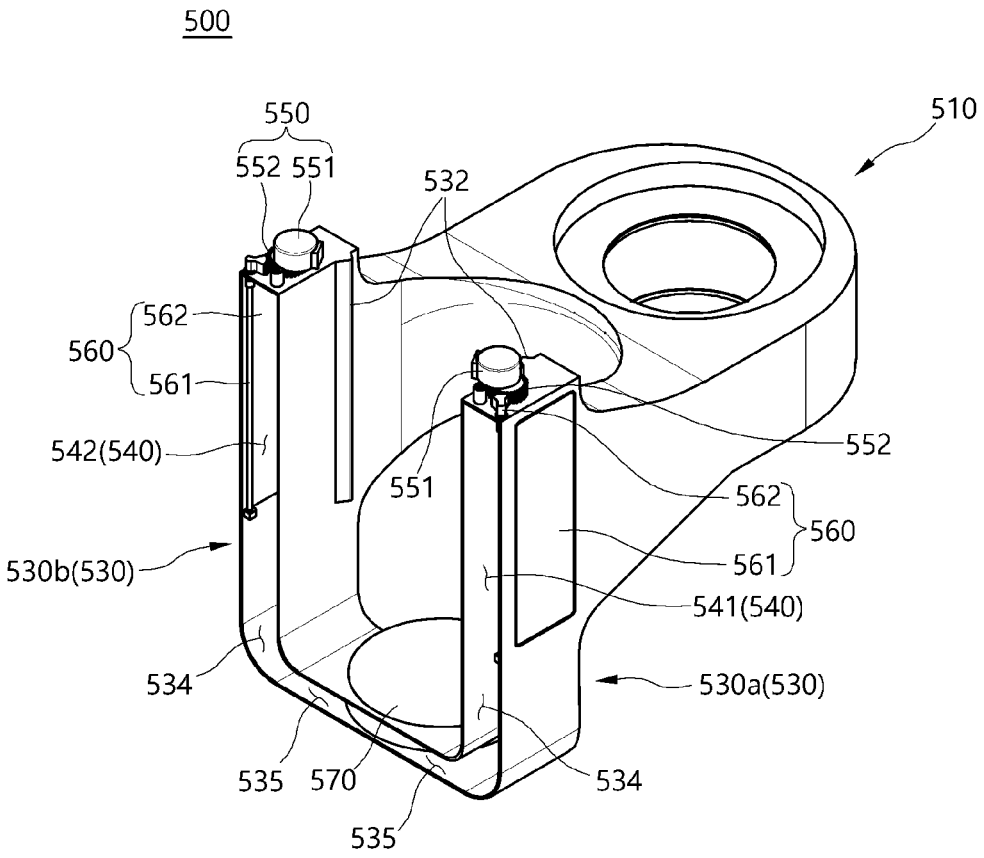
FIG. 12 is a cross-sectional perspective view illustrating the flow passage forming unit of FIG. 10.
Figure 13:
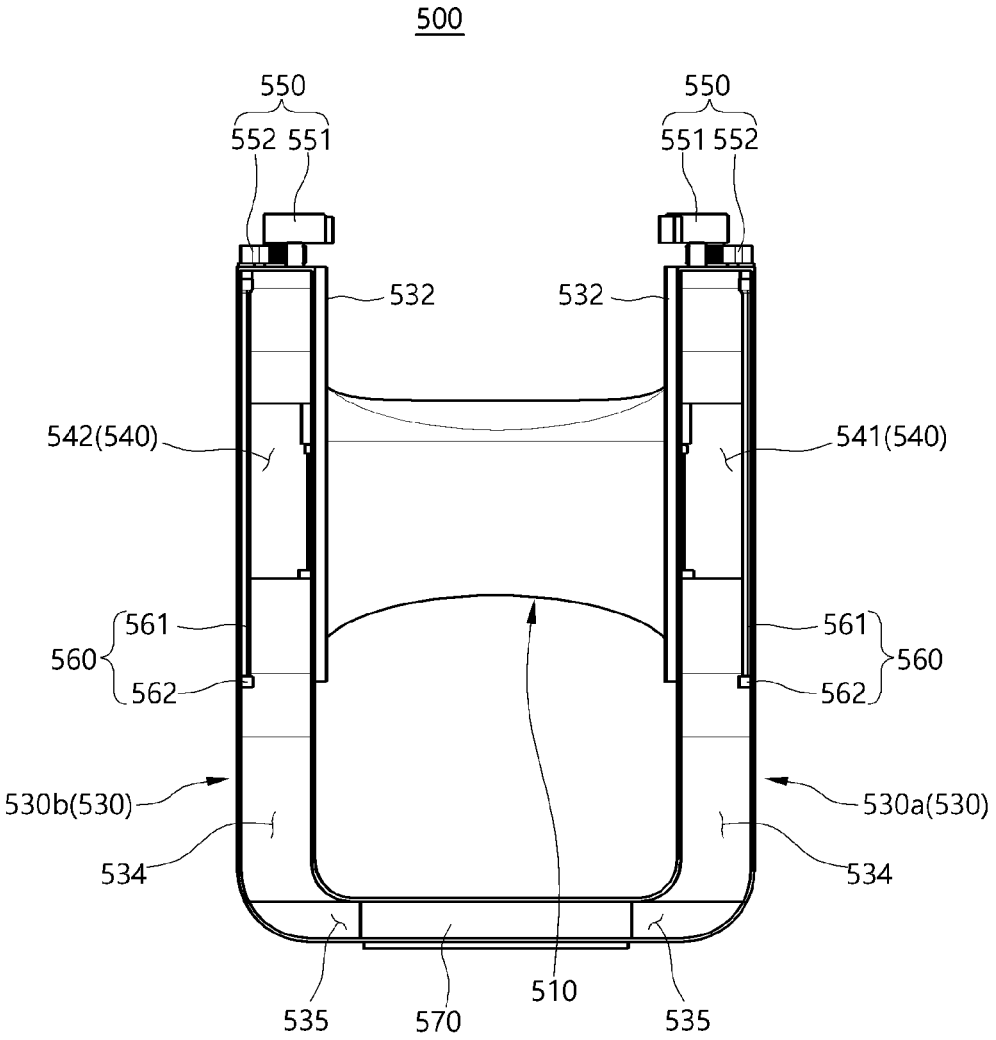
FIG. 13 is a cross-sectional view illustrating the flow passage forming unit of FIG. 10.
Figure 14:
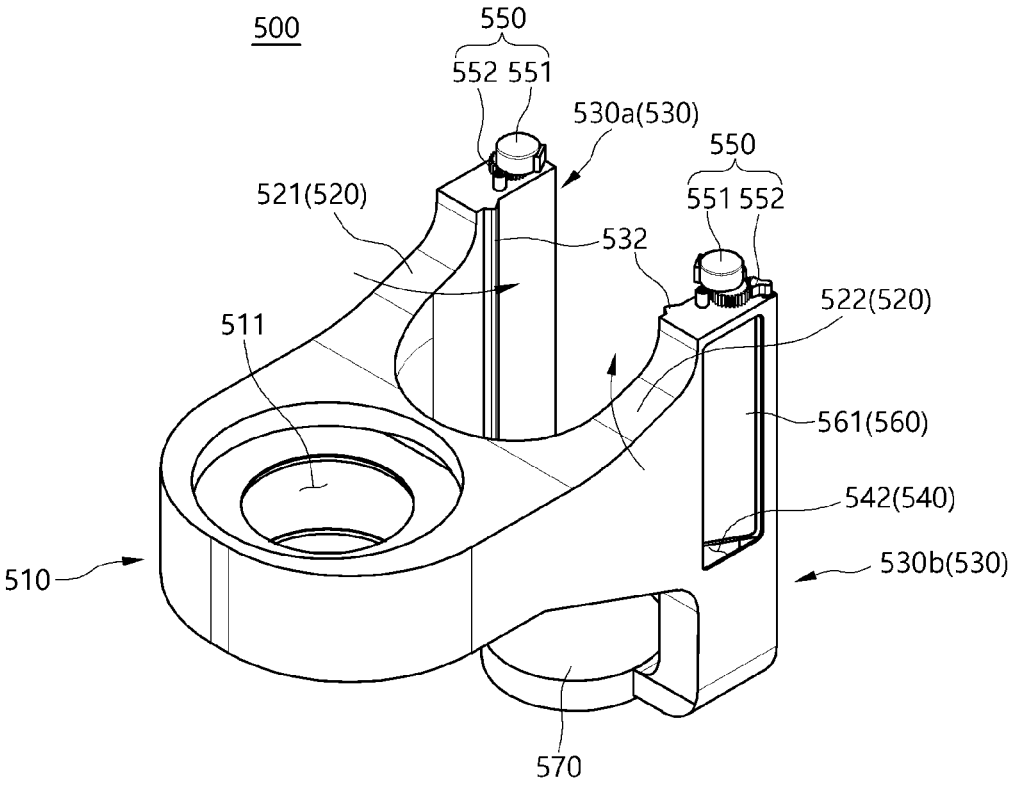
FIG. 14 is a usage state diagram illustrating an operation process of the flow passage forming unit of FIG. 10.
Figure 15:
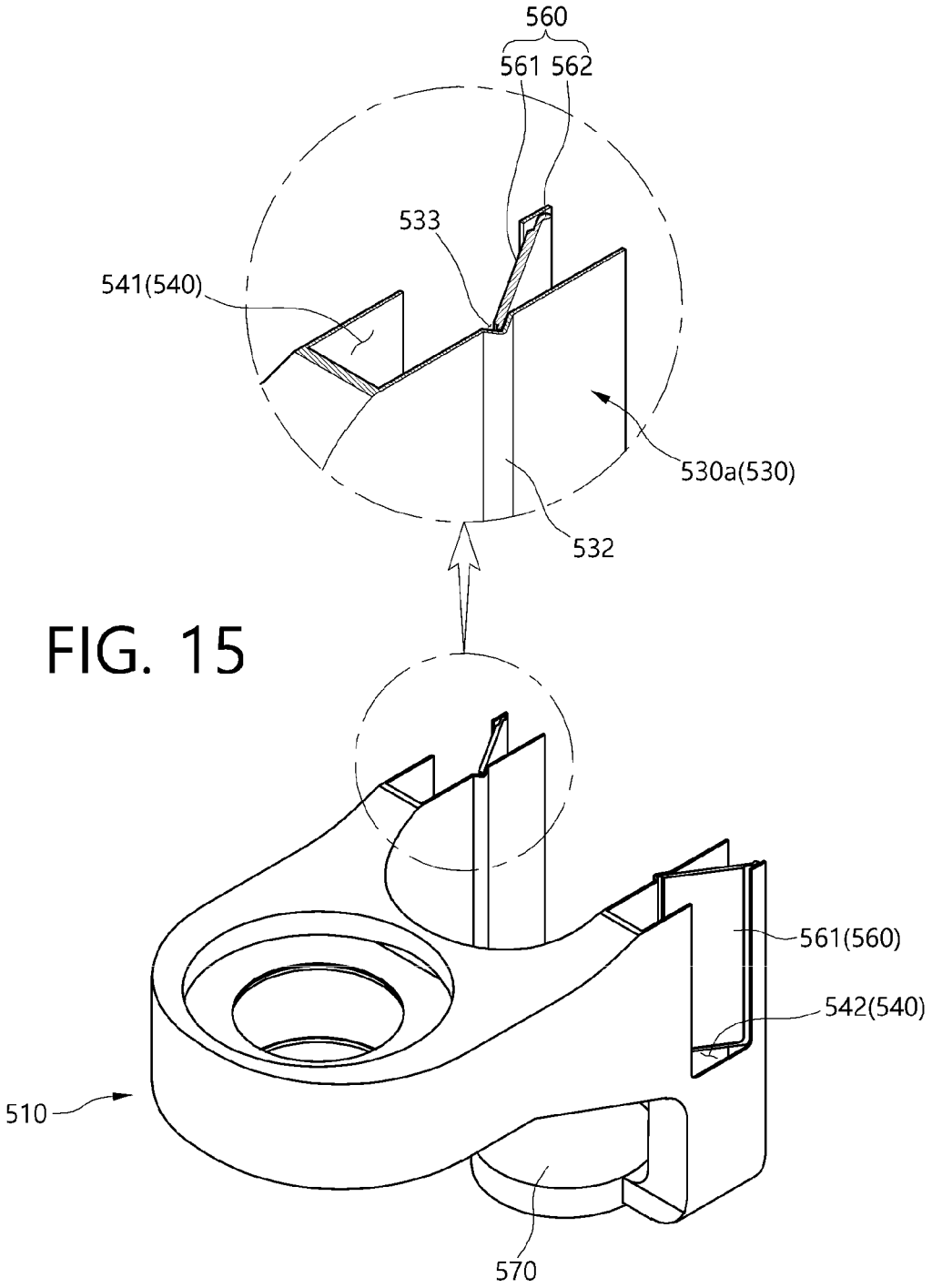
FIG. 15 is a cross-sectional perspective view illustrating a state of the flow passage forming unit in the state of FIG. 14.
Figure 16:
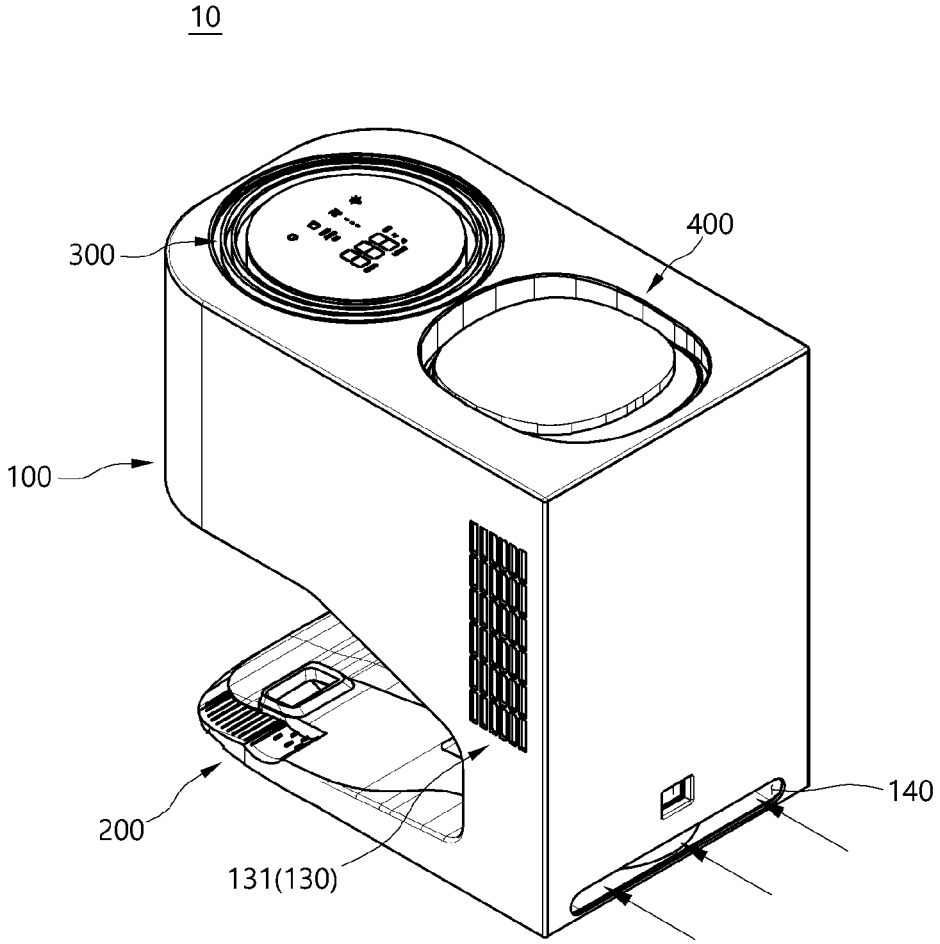
FIGS. 16 to 19 are usage state diagrams illustrating a state in which the air purifier of FIG. 1 is operated focusing on the dust, etc. suction function.
Figure 17:
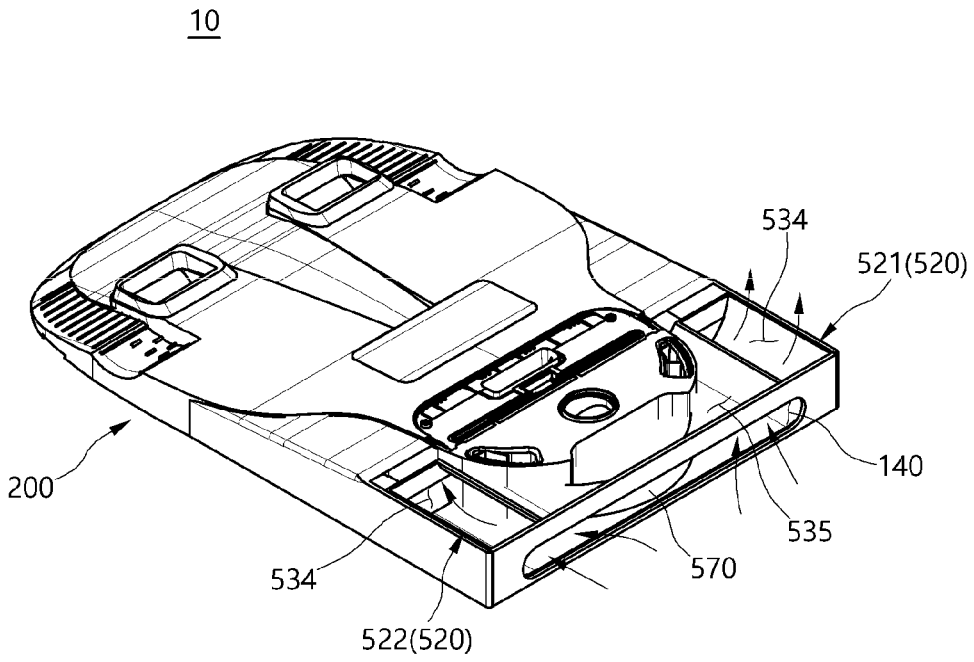

In the embodiment shown in FIG. 9, the air purification unit 300 includes a purification housing 310, a fan member 320, a power member 330, a control member 340, and a filter member 350.

The purification housing 310 forms the outer shape of the air purification unit 300. A space may be formed inside the purification housing 310 to accommodate different components of the air purification unit 300. In the illustrated embodiment, the fan member 320, the power member 330, and the control member 340 are accommodated in the space formed inside the purification housing 310.

The purification housing 310 is at least partially accommodated in the purification coupling hole 151 and the purification accommodation part 511. The purification housing 310 accommodated in the purification coupling hole 151 and the purification accommodation part 511 may be supported by the support rib 150 or the purification support part 510.

The purification housing 310 may be provided in any form that accommodates different components of the air purification unit 300 and can be coupled to the housing 100 or the flow passage forming unit 500. In the illustrated embodiment, the purification housing 310 is formed in a cylindrical shape having a circular cross-section and a height in the up-down direction. The space is formed inside the purification housing 310.

In this case, one side in the height direction of the purification housing 310, that is, the upper side in the illustrated embodiment, is formed to be open. The space may be communicated with the outside through the upper side. The fan member 320, the power member 330, and the control member 340 may be accommodated in the space through the upper side.

The other side in the height direction of the purification housing 310, that is, the lower side in the illustrated embodiment, is sealed. In this case, a hollow is formed through the inside of the lower surface of the purification housing 310 and communicates with a hollow formed inside the filter member 350. Accordingly, the air flowing into the hollow of the filter member 350 in the radial direction may flow in the height direction through the hollow of the purification housing 310 and be discharged to the outside of the air purifier 10. The space of the purification housing 310 communicates with the filter member 350 and the outside.

The fan member 320 provides a conveying force for external air to flow into the air purifier 10. In addition, the fan member 320 provides a conveying force for the air filtered through the filter member 350 to be discharged to the outside.

The fan member 320 is coupled to the purification housing 310. Specifically, the fan member 320 is rotatably accommodated in the space of the purification housing 310. The fan member 320 may be rotatably coupled to the lower surface of the purification housing 310.

The fan member 320 may be provided in any shape that can provide a conveying force to the air. In the illustrated embodiment, the fan member 320 is configured to include a plurality of blades extending obliquely along its outer circumference.

The fan member 320 is coupled to the power member 330.

The power member 330 provides power to rotate the fan member 320. The power member 330 is coupled to the fan member 320. In the illustrated embodiment, the power member 330 may be coupled to the upper center of the fan member 320 to rotate the fan member 320.

The power member 330 is energizably connected to the control member 340 and a power source (not shown). The power member 330 may be operated by electric power provided by a power source (not shown) according to a control signal applied to the control member 340.

The power member 330 is accommodated in the space of the purification housing 310. The power member 330 is arranged to face the lower surface of the purification housing 310 with the fan member 320 interposed therebetween.

The power member 330 may be provided in any shape capable of providing rotational force to the fan member 320. In an embodiment, the power member 330 may be provided as a motor.

The power member 330 is energizably coupled to the control member 340.

The control member 340 receives an input of a control signal for controlling the power member 330. The control member 340 may be exposed to the outside of the housing 100 and can receive an input of a control signal from the user.

The control member 340 is coupled to the housing cover 160. The control member 340 may be at least partially accommodated in the first cover coupling hole 161*a* and exposed to the outside.

The control member 340 is coupled to the power member 330. The control member 340 is energizably coupled to the power member 330.

The control member 340 is coupled to the purification housing 310. The control member 340 may be at least partially accommodated in the space of the purification housing 310.

The control member 340 may be provided in any shape capable of receiving an input of a control signal from the user. In the illustrated embodiment, the control member 340 is configured to include a plurality of buttons that can be pressed to receive an input of a control signal.

The dust collection unit 400 receives dust, etc. received from a robot vacuum cleaner (not shown). The dust collection unit 400 is coupled to the housing 100. The dust collection unit 400 is accommodated in the housing space 120.

The dust collection unit 400 is supported by the support rib 150. The dust collection unit 400 may be accommodated in the collection coupling hole 152 formed inside the support rib 150.

As described above, in an embodiment in which a robot vacuum cleaner (not shown) is mounted on the base 200, the dust collection unit 400 may communicate with a dust, etc. flow passage (not shown) formed in the base 200. In this case, a space may be formed inside the dust collection unit 400 to accommodate dust, etc., and may communicate with a dust, etc. flow passage (not shown). In addition, the space of the dust collection unit 400 may be provided with a member such as a cyclone (not shown) to provide a conveying force to dust, etc. introduced into a dust, etc. flow passage (not shown).

The dust collection unit 400 is formed to extend in the height direction of the housing 100, that is, in the front-rear direction in the illustrated embodiment. The dust collection unit 400 may be formed in a shape corresponding to the shape of the housing space 120.

The flow passage forming unit 500 forms a flow passage through which air introduced from the outside flows toward the air purification unit 300. The flow passage forming unit 500 communicates the air purification unit 300 and the outside, that is, a passage through which air is introduced.

The flow passage forming unit 500 is coupled to the housing 100. The flow passage forming unit 500 is accommodated in the housing space 120. The flow passage forming unit 500 may be supported by the support rib 150.

The flow passage forming unit 500 is coupled to base 200. One side in the height direction of the flow passage forming unit 500, that is, the lower side in the illustrated embodiment, may be supported by being coupled to the base 200.

The flow passage forming unit 500 is coupled to the air purification unit 300. The flow passage forming unit 500 supports one component of the air purification unit 300, that is, the filter member 350 in the illustrated embodiment. The flow passage forming unit 500 communicates with the filter member 350.

The flow passage forming unit 500 is coupled to the dust collection unit 400. The flow passage forming unit 500 may at least partially surrounds the dust collection unit 400 and accommodate the dust collection unit 400.

The flow passage forming unit 500 communicates with the outside. Specifically, the flow passage forming unit 500 communicates with the outside through the clean inlet part 130. The air introduced through the clean inlet part 130 may flow along the flow passage forming unit 500 and be delivered to the air purification unit 300.

In addition, the flow passage forming unit 500 communicates with the outside through the dust inlet part 140. The air introduced through the dust inlet part 140 may flow along the flow passage forming unit 500 and be delivered to the air purification unit 300. In this case, some components of the flow passage forming unit 500 connecting the dust inlet part 140 and the air purification unit 300 extend vertically, so that dust, etc. introduced with air may fall out due to gravity. The fallen dust, etc. is collected inside the flow passage forming unit 500.

In this case, the flow passage forming unit 500 may open or close the clean inlet part 130. Therefore, it can be said that the flow passage forming unit 500 controls the flow passage through which external air is introduced into the air purifier 10.

Furthermore, depending on whether the flow passage forming unit 500 opens or closes the clean inlet part 130, the intensity of the conveying force applied to the air flowing in through the dust inlet part 140 may be adjusted. This will be described later in detail.

In the embodiments shown in FIGS. 10 to 15, the flow passage forming unit 500 includes a purification support part 510, a flow passage arm 520, an opening/closing member support part 530, an opening/closing member accommodation part 540, an opening/closing power part 550, an opening/closing member 560, and a branch member 570.

The purification support part 510 forms part of the outer shape of the flow passage forming unit 500. The purification support part 510 supports the air purification unit 300. In an embodiment, the purification support part 510 may be coupled to the filter member 350 and support it.

The purification support part 510 is seated on the support rib 150. The purification support part 510 is supported by the support rib 150.

The purification support part 510 may have a shape corresponding to the shape of the support rib 150. In the illustrated embodiment, the purification support part 510 has a circular cross-section and a height in the up-down direction, and a hollow (i.e., the purification accommodation part 511 to be described later) formed therein. One side of the purification support part 510 in the longitudinal direction, that is, the rear side in the illustrated embodiment, is formed open and may accommodate the dust collection unit 400.

The purification support part 510 is coupled to the flow passage arm 520. In the illustrated embodiment, the one side in the longitudinal direction of the purification support part 510, that is, the rear side in the illustrated embodiment, is coupled to the flow passage arm 520.

The purification support part 510 communicates with the flow passage arm 520. In addition, the purification support part 510 is coupled to and communicates with the air purification unit 300. The purification support part 510 communicates the filter member 350 and the flow passage arm 520. Air flowing along the flow passage arm 520 may flow out to the filter member 350 through the purification support part 510.

In the illustrated embodiment, the purification support part 510 includes a purification accommodation part 511, a dust accommodation part 512, and a purification flow passage 513.

The purification accommodation part 511 accommodates the air purification unit 300. The purification accommodation part 511 is formed through the inside of the purification support part 510 in its height direction, that is, in the up-down direction in the illustrated embodiment. In an embodiment, the purification accommodation part 511 may accommodate the filter member 350. The purification accommodation part 511 communicates with the filter member 350.

The purification accommodation part 511 communicates with the purification coupling hole 151. The purification accommodation part 511 may be arranged to overlap the purification coupling hole 151 in the height direction of the purification support part 510, that is, in the up-down direction in the illustrated embodiment.

Figure 18:
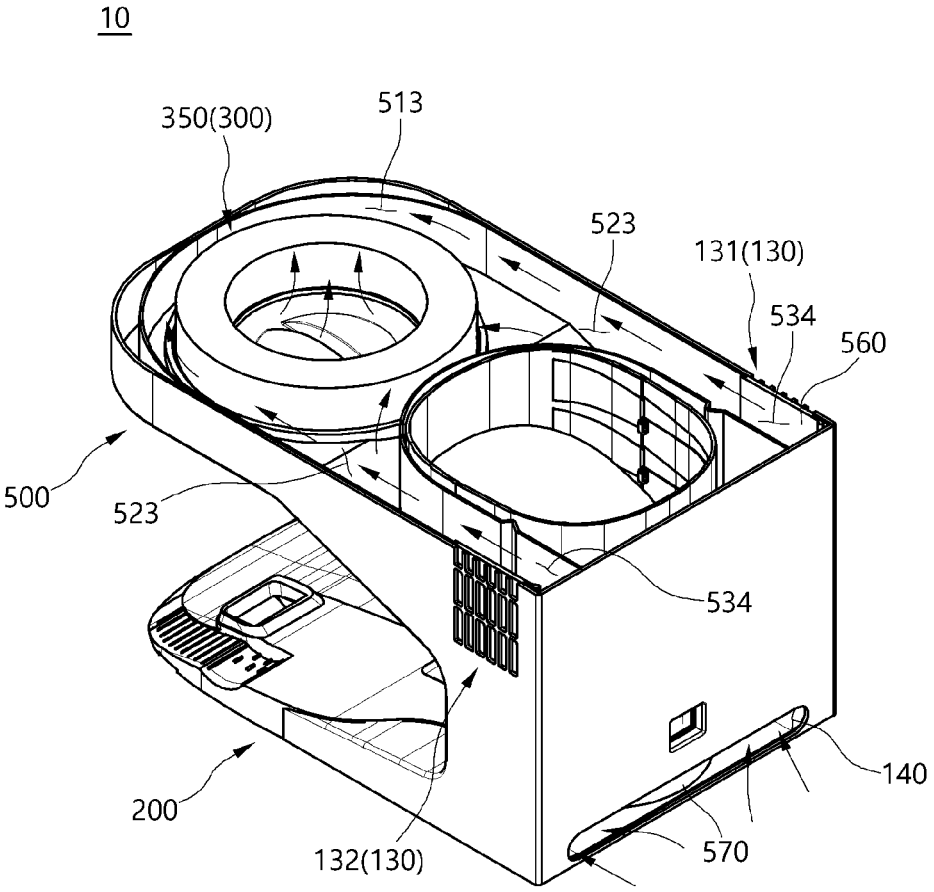
Figure 21:
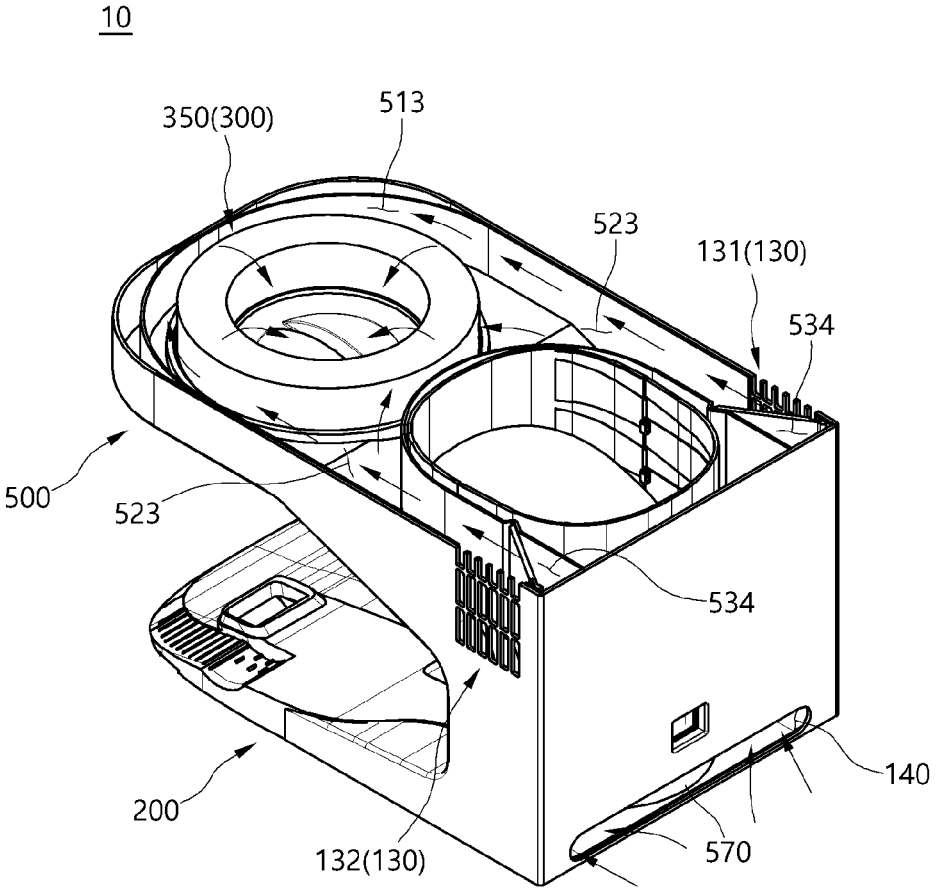

The purification accommodation part 511 communicates with the purification flow passage 513 (see FIGS. 18 and 21). Air flowing along the purification flow passage 513 may flow into the purification accommodation part 511 and the filter member 350 accommodated therein. As will be described later, the purification accommodation part 511 communicates with the purification flow passage 513 in the outer circumferential direction. The flowed air may flow radially inward and pass through the purification accommodation part 511 and the filter member 350 accommodated therein.

The purification accommodation part 511 may be of any shape capable of accommodating the filter member 350 and communicating the filter member 350 and the purification flow passage 513. In the illustrated embodiment, the purification accommodation part 511 is formed as a cylindrical space having a circular cross-section and a height in the up-down direction. Each end of the purification accommodation part 511 in the height direction is formed open. The filter member 350 may be withdrawably accommodated in the purification accommodation part 511 through the lower side of the purification accommodation part 511.

The dust accommodation part 512 accommodates the dust collection unit 400. The dust accommodation part 512 may accommodate the dust collection unit 400 in a withdrawable manner.

The dust accommodation part 512 is defined partially surrounded by the purification accommodation part 511. In the illustrated embodiment, the dust accommodation part 512 is located biased on one side of the purification accommodation part 511 in the longitudinal direction, that is, on the rear side. The dust accommodation part 512 is arranged to be spaced apart from the purification accommodation part 511.

The dust accommodation part 512 is partially surrounded by a pair of flow passage arms 520. In the illustrated embodiment, the left side of the dust accommodation part 512 is surrounded by the first flow passage arm 521, and the right side of the dust accommodation part 512 is surrounded by the second flow passage arm 522.

The dust accommodation part 512 may have a shape corresponding to the shape of the dust collection unit 400. In the illustrated embodiment, the dust accommodation part 512 is formed to be rounded so that one side facing the purification accommodation part 511, that is, the front side, is convex outward. The other side of the dust accommodation part 512 facing the fourth housing surface 114, that is, the rear side, is formed open.

The dust accommodation part 512 communicates with the collection coupling hole 152. The dust accommodation part 512 may be arranged to overlap the collection coupling hole 152 in the height direction of the purification support part 510, that is, in the up-down direction in the illustrated embodiment.

The purification flow passage 513 is defined as a space formed inside the purification support part 510. The purification flow passage 513 communicates the purification accommodation part 511 and the arm flow passage 523 (see FIGS. 18 and 21). The purification flow passage 513 communicates with the purification accommodation part 511 and the arm flow passage 523, respectively.

The purification flow passage 513 may have a shape corresponding to the shape of the purification support part 510. In the illustrated embodiment, the purification flow passage 513 extends to surround the filter member 350 accommodated in the purification accommodation part 511 radially outward.

That is, the purification flow passage 513 may be defined by one portion that surrounds the filter member 350 radially on the outside and extends in the outer circumferential direction of the filter member 350, and the other portion that is continuous with the one portion and extends in the front-rear direction toward the arm flow passage 523.

The radial inner side of the one portion of the purification flow passage 513 is open and communicates with the filter member 350. Each front and rear end of the other portion of the purification flow passage 513 is open and communicates with the one portion of the purification flow passage 513 and the arm flow passage 523, respectively.

The flow passage arm 520 forms another part of the outer shape of the flow passage forming unit 500. The flow passage arm 520 partially surrounds the dust accommodation part 512. In addition, the flow passage arm 520 is coupled to the purification support part 510 and the opening/closing member support part 530, respectively. In the illustrated embodiment, one end of the flow passage arm 520 in its extension direction, that is, the front end, is coupled to the purification support part 510. In addition, the other end of the flow passage arm 520 in its extension direction, that is, the rear end, is coupled to the opening/closing member support part 530.

The flow passage arm 520 communicates with the purification support part 510 and the opening/closing member support part 530, respectively. The flow passage arm 520 communicates the purification support part 510 and the opening/closing member support part 530.

A plurality of flow passage arms 520 may be provided. The plurality of flow passage arms 520 may be arranged to be spaced apart from each other and may be coupled to the purification support part 510 and the opening/closing member support part 530 at different positions, respectively, and communicate them.

In the illustrated embodiment, the flow passage arm 520 includes a first flow passage arm 521, a second flow passage arm 522, and an arm flow passage 523.

The first flow passage arm 521 forms part of the plurality of flow passage arms 520. In the illustrated embodiment, the first flow passage arm 521 is located biased on one side in the width direction of the air purifier 10, that is, on the left side. The first flow passage arm 521 is coupled to the purification support part 510 and a first support part **530*a***, respectively, on the one side above in the width direction.

The second flow passage arm 522 forms another part of the plurality of flow passage arms 520. In the illustrated embodiment, the second flow passage arm 522 is located biased on the other side in the width direction of the air purifier 10, that is, on the right side. The second flow passage arm 522 is coupled to the purification support part 510 and a second support part 530*b*, respectively, on the other side above in the width direction.

The first flow passage arm 521 and the second flow passage arm 522 each surround the dust accommodation part 512. In the illustrated embodiment, the first flow passage arm 521 and the second flow passage arm 522 are arranged to face each other in the width direction of the air purifier 10, that is, in the left-right direction, with the dust accommodation part 512 interposed therebetween.

An arm flow passage 523 is formed inside the first flow passage arm 521 and the second flow passage arm 522.

The arm flow passage 523 is defined as a space formed inside the first and second flow passage arms 521 and 522. The arm flow passage 523 communicates the purification flow passage 513, and a first connection flow passage 534 formed inside the opening/closing member support part 530. Air flowing into the first connection flow passage 534 may flow into the purification flow passage 513 along the arm flow passage 523.

The arm flow passage 523 may have a shape corresponding to the shape of the first and second flow passage arms 521 and 522. In the illustrated embodiment, the arm flow passage 523 extends in the longitudinal direction of the air purifier 10, that is, in the front-rear direction. Each end in the extension direction of the arm flow passage 523 is formed open. The front end of the arm flow passage 523 communicates with the purification flow passage 513. The rear end of the arm flow passage 523 communicates with the first connection flow passage 534.

The opening/closing member support part 530 rotatably supports the opening/closing member 560. A portion of the space formed in the inner side of the opening/closing member 560 is defined as the opening/closing member accommodation part 540, which may accommodate the opening/closing member 560.

In addition, the opening/closing member support part 530 is coupled to the opening/closing power part 550 and supports the opening/closing power part 550. Furthermore, the opening/closing member support part 530 is coupled to the branch member 570 and supports the branch member 570.

The opening/closing member support part 530 is coupled to the flow passage arm 520. The opening/closing member support part 530 is coupled to one end of the flow passage arm 520 in the extension direction, that is, to the rear end in the illustrated embodiment. As described above, a plurality of flow passage arms 520 may be provided. Accordingly, a plurality of opening/closing member support parts 530 may also be provided and coupled to a plurality of flow passage arms 520, respectively.

In the illustrated embodiment, the opening/closing member support part 530 is provided as a pair including a first support part 530*a* and a second support part 530*b*. The first support part 530*a* is coupled to the first flow passage arm 521, and the second support part 530*b* is coupled to the second flow passage arm 522, respectively.

The opening/closing member support part 530 communicates with the flow passage arm 520. In the above embodiment, the first support part 530*a* communicates with the first flow passage arm 521, and the second support part 530*b* communicates with the second flow passage arm 522, respectively.

The opening/closing member support part 530 may be of any shape that can be combined to the flow passage arm 520, the opening/closing member accommodation part 540, the opening/closing power part 550, the opening/closing member 560, and the branch member 570. In the illustrated embodiment, the opening/closing member support part 530 includes one component extending in the up-down direction and coupled to a plurality of flow passage arms 520 (i.e., the first support part 530*a* and the second support part 530*b* described above), respectively, and another component extending in the left-right direction between one end of the extension direction of the one component.

That is, the opening/closing member support part 530 may be configured to include one component extending in the height direction of the air purifier 10, and another component continuous with the one component and extending in the width direction of the air cleaner 10.

In this case, the flow passage through which air introduced from the outside flows toward the air purification unit 300 may be formed by both the one component and the another component.

In the illustrated embodiment, the opening/closing member support part 530 includes a support body 531, a limiting protrusion 532, a limiting space 533, a first connection flow passage 534, and a second connection flow passage 535.

The support body 531 forms part of the outer shape of the opening/closing member support part 530. The support body 531 is formed to extend in the height direction of the opening/closing member support part 530, that is, in the up-down direction in the illustrated embodiment.

The support body 531 is coupled to the flow passage arm 520. The support body 531 is coupled to one end of the flow passage arm 520 in the extension direction, that is, to the rear end in the illustrated embodiment.

The opening/closing power part 550 is located at one end of the support body 531 in the height direction, that is, at the upper end in the illustrated embodiment. The one end of the support body 531 rotatably supports the opening/closing power part 550.

At the other end of the support body 531 in the height direction, that is, the lower end in the illustrated embodiment, the another component extending in the width direction, that is, in the left-right direction, is formed. As described above, the another component is continuous with the lower ends of the first support part 530*a* and the second support part 530*b*, respectively.

A space is formed inside the support body 531. The space communicates with the clean inlet part 130, the dust inlet part 140, and the arm flow passage 523, respectively. In addition, the space formed inside the support body 531 may accommodate rotated opening/closing member 560. Furthermore, the space of the support body 531 accommodates the branch member 570 that branches off the flow passage of air introduced into the dust inlet part 140.

The support body 531 rotatably supports the opening/closing member 560. The space formed inside the support body 531 may be optionally communicated with the clean inlet part 130 by the opening/closing member 560. The opening/closing member 560 is rotatably coupled to the outer side of the support body 531 in the width direction.

In this case, the support body 531 may rotatably support the opening/closing member 560 on one side facing the clean inlet part 130.

In the illustrated embodiment, the opening/closing member 560 coupled to the first support part 530*a* is located on the left side of the first support part 530*a* and is configured to open or close the first clean inlet part 131. In addition, the opening/closing member 560 coupled to the second support part 530*b* is configured to open and close the second clean inlet part 132 located on the left side of the second support part 530*b*.

The limiting protrusion 532 is coupled to the support body 531. Inside the limiting protrusion 532, a limiting space 533 is formed that communicates with the opening/closing member accommodation part 540 formed inner side of the support body 531. The limiting protrusion 532 is configured to contact the rotating opening/closing member 560 with its inner surface to limit the rotation angle of the opening/closing member 560.

The limiting protrusion 532 is located at the inner side of the support body 531 in the width direction. The limiting protrusion 532 is located on the other side opposite to the clean inlet part 130.

In the illustrated embodiment, the limiting protrusion 532 provided on the first support part 530*a* is located on the right side of the first support part 530*a* and is configured to limit the rotation angle of the opening/closing member 560. In addition, the limiting protrusion 532 provided on the second support part 530*b* is located on the left side of the second support part 530*b* and is configured to limit the rotation angle of the opening/closing member 560.

The limiting protrusion 532 may have any shape capable of limiting the rotation angle of the opening/closing member 560. In the illustrated embodiment, the limiting protrusion 532 is configured to include a pair of continuous surfaces forming a predetermined angle with each other. In the above embodiment, the limiting protrusion 532 has a triangular cross-section and is in the shape of a triangular column extending in the up-down direction.

A space formed inside the limiting protrusion 532 is defined as a limiting space 533.

The limiting space 533 partially accommodates the opening/closing member 560 that is rotated to open the clean inlet part 130. In the illustrated embodiment, the limiting space 533 accommodates one end in the longitudinal direction of the opening/closing member 560 that is rotated, that is, a portion adjacent to the front end.

The limiting space 533 is formed inside the limiting protrusion 532. The limiting space 533 is partially surrounded by the inner circumference of the limiting protrusion 532. In the illustrated embodiment, of each side of the limiting space 533, one side opposite to the clean inlet part 130, that is, the inner side, is surrounded by the inner circumference of the limiting protrusion 532. Of each side of the limiting space 533, the other side facing the clean inlet part 130, that is, the outer side, is open and communicates with the opening/closing member accommodation part 540.

The space formed inside the support body 531 may be divided into a first connection flow passage 534, a second connection flow passage 535, and an opening/closing member accommodation part 540.

The first connection flow passage 534 is defined as a part of the space formed inside the support body 531. The first connection flow passage 534 extends between the second connection flow passage 535 and the opening/closing member accommodation part 540. In the illustrated embodiment, the first connection flow passage 534 communicates with the lower end of the opening/closing member accommodation part 540 and an end of the second connection flow passage 535 in the width direction, that is, in the left-right direction, respectively.

The first connection flow passage 534 may extend in the height direction of the support body 531. In the illustrated embodiment, the first connection flow passage 534 extends in the up-down direction. In an embodiment, the first connection flow passage 534 may extend perpendicular to the second connection flow passage 535.

Therefore, large particles of dust, etc. mixed in the air introduced into the opening/closing member accommodation part 540 through the clean inlet part 130 may fall out by their own weight and may be collected in the second connection flow passage 535 through the first connection flow passage 534.

The second connection flow passage 535 is defined as another part of the space formed inside the support body 531. The second connection flow passage 535 communicates with the first connection flow passage 534 and the dust inlet part 140. That is, the second connection flow passage 535 forms the most upstream side of the flow passage through which air introduced from the outside flows inside the air purifier 10.

The second connection flow passage 535 communicates with the first connection flow passage part 534. As described above, the first connection flow passage 534 may be formed inside each of the plurality of support parts 530*a* and 530*b*. The second connection flow passage 535 communicates with a pair of first connection flow passages 534 that are spaced apart from each other in the width direction, that is, in the left-right direction in the illustrated embodiment.

The second connection flow passage 535 extends in the width direction of the air purifier 10, that is, in the left-right direction in the illustrated embodiment. In this case, the extension direction of the second connection flow passage 535 may be the same as the extension direction of the dust inlet part 140.

The second connection flow passage 535 is arranged to at least partially overlap the dust inlet part 140 in the longitudinal direction of the air purifier 10, that is, in the front-rear direction in the illustrated embodiment. In other words, the second connection flow passage 535 is arranged to overlap the dust inlet part 140 along the direction in which external air or dust, etc. is introduced into the dust inlet part 140.

The branch member 570 is located on the second connection flow passage 535. External air or dust, etc. introduced through the dust inlet part 140 may be branched by the branch member 570 and flow evenly into the plurality of first connection flow passages 534.

The opening/closing member accommodation part 540 accommodates the opening/closing member 560. The opening/closing member accommodation part 540 is defined as the remaining part of the space formed inside the support body 531. The opening/closing member accommodation part 540 is located on one side in the height direction of the support body 531, that is, on the upper side in the illustrated embodiment.

The opening/closing member accommodation part 540 communicates with the clean inlet part 130. As described above, the opening/closing member accommodation part 540 may be optionally communicated with the clean inlet part 130 by the opening/closing member 560.

The opening/closing member accommodation part 540 communicates with the arm flow passage 523. In the illustrated embodiment, the opening/closing member accommodation part 540 communicates with the rear end of the arm flow passage 523.

The opening/closing member accommodation part 540 communicates with the first connection flow passage 534. In the illustrated embodiment, the opening/closing member accommodation part 540 communicates with the upper end of the first connection flow passage 534.

The opening/closing member accommodation part 540 communicates the arm flow passage 523 and the first connection flow passage 534. The opening/closing member accommodation part 540 is located between the arm flow passage 523 and the first connection flow passage 534.

The opening/closing member accommodation part 540 may have any shape capable of accommodating the opening/closing member 560. In the illustrated embodiment, the opening/closing member accommodation part 540 is formed as a space that has a length in the front-rear direction, a width in the left-right direction, and a height in the up-down direction, corresponding to the shape of the support body 531.

The opening/closing member accommodation part 540 communicates with the arm flow passage 523 in its longitudinal direction. The opening/closing member accommodation part 540 communicates with the clean inlet part 130 in its width direction. The opening/closing member accommodation part 540 communicates with the first connection flow passage 534 in its height direction.

A plurality of opening/closing member accommodation parts 540 may be defined. The plurality of opening/closing member accommodation parts 540 may be formed inside the plurality of opening/closing member support parts 530, respectively. In the illustrated embodiment, the opening/closing member accommodation part 540 includes a first accommodation part 541 formed inside the first support part 530*a* and a second accommodation part 542 formed inside the second support part 530*b*.

The first accommodation part 541 communicates with the arm flow passage 523 formed inside the first flow passage arm 521, the first clean inlet part 131, and the first connection flow passage 534 formed in the first support part 530*a*. The second accommodation part 542 communicates with the arm flow passage 523 formed inside the second flow passage arm 522, the second clean inlet part 132, and the first connection flow passage 534 formed in the second support part 530*b*.

The opening/closing power part 550 provides rotational force to rotate the opening/closing member 560. The opening/closing power part 550 may be energizably connected to an external power source (not shown) and a control unit (not shown) and may receive electric power and control signals. In an embodiment, the opening/closing power part 550 may be energizably connected to the control member 340 and may receive control signals.

The opening/closing power part 550 is coupled to the opening/closing member support part 530. In the illustrated embodiment, the opening/closing power part 550 is coupled to one end in the height direction of the support body 531, that is, the upper end.

The opening/closing power part 550 is coupled to the opening/closing member 560. The opening/closing power part 550 may be coupled to an opening/closing shaft member 562 of the opening/closing member 560 to rotate the opening/closing member 560.

A plurality of opening/closing power parts 550 may be provided. The plurality of opening/closing power parts 550 may be arranged in the plurality of support parts 530*a* and 530*b*, respectively. In the illustrated embodiment, a pair of opening/closing power parts 550 are provided and are coupled to the support body 531 of the first support part 530*a* and the opening/closing member 560 coupled thereto, and the support body 531 of the second support part 530*b* and the opening/closing member 560 coupled thereto, respectively.

In the illustrated embodiment, the opening/closing power part 550 includes a motor member 551 and a gear member 552.

The motor member 551 generates rotational force to rotate the opening/closing member 560. The motor member 551 may be energizably connected to an external power source (not shown), a control unit (not shown), or the control member 340 to receive electric power and control signals. The motor member 551 may rotate the opening/closing member 560 in a direction to open the clean inlet part 130 and in a direction to close the clean inlet part 130.

The motor member 551 is coupled to the gear member 552. The gear member 552 is coupled to the motor member 551 and the opening/closing shaft member 562, respectively, and transmits the rotational force of the motor member 551 to the opening/closing shaft member 562.

The opening/closing member 560 opens or closes the clean inlet part 130. The opening and closing member 560 is configured to be rotatably coupled to the opening/closing member support part 530 to allow or block communication between the clean inlet part 130 and the opening/closing member accommodation part 540.

The opening/closing member 560 is rotatably coupled to the support body 531. The opening/closing member 560 is arranged on one side of each side of the support body 531 facing the clean inlet part 130, that is, on the outer side.

A plurality of opening/closing members 560 may be provided. The plurality of opening/closing members 560 may be configured to be rotatably coupled to the support bodies 531 provided in the plurality of support parts 530*a* and 530*b*, respectively, to open or close the plurality of clean inlet parts 130, respectively.

In the illustrated embodiment, a plurality of opening/closing members 560 are provided and rotatably coupled to the support body 531 of the first support part 530*a* and the support body 531 of the second support part 530*b*, respectively. The opening/closing member 560 coupled to the first support part 530*a* is configured to open or close the first clean inlet part 131. The opening/closing member 560 coupled to the second support part 530*b* is configured to open or close the second clean inlet part 132.

The opening/closing member 560 may be arranged to overlap the clean inlet part 130 along the width direction of the air purifier 10. The opening/closing member 560 may be located in the inner side of the clean inlet part 130. The opening/closing member 560 may be rotated in a direction opposite to the clean inlet part 130 to open the clean inlet part 130, and be rotated in a direction toward the clean inlet part 130 to close the clean inlet part 130.

Therefore, even though the opening/closing member 560 is rotated to open the clean inlet part 130, the opening/closing member 560 is not exposed to the outside of the air purifier 10.

In the illustrated embodiment, the opening/closing member 560 coupled to the first support part 530*a* is located on the right side of the first clean inlet part 131 and is configured to open or close the first clean inlet part 131. The opening/closing member 560 coupled to the first support part 530*a* may be rotated counterclockwise to open the first clean inlet part 131, and rotated clockwise to close the first clean inlet part 131.

In this case, the rotation angle in a direction in which the opening/closing member 560 opens the first clean inlet part 131, that is, counterclockwise, may be limited to the angle until the opening/closing member 560 comes into contact with the limiting protrusion 532.

In addition, the opening/closing member 560 coupled to the second support part 530*b* is located on the left side of the second clean inlet part 132 and is configured to open or close the second clean inlet part 132. The opening/closing member 560 coupled to the second support part 530*b* may be rotated clockwise to open the second clean inlet part 132, and rotated counterclockwise to close the second clean inlet part 132.

In this case, the rotation angle in a direction in which the opening/closing member 560 opens the second clean inlet part 132, that is, clockwise, may be limited to the angle until the opening/closing member 560 comes into contact with the limiting protrusion 532.

The opening/closing member 560 may be rotated at various angles by the opening/closing power part 550. That is, the opening/closing member 560 may be rotated to any one position of a first position to close the clean inlet part 130, a second position in contact with the limiting protrusion 532, and a third position between the first position and the second position.

Accordingly, not only whether air is introduced through the clean inlet part 130, but also the flow rate of the incoming air can be adjusted.

In the illustrated embodiment, the opening/closing member 560 includes an opening/closing body 561 and an opening/closing shaft member 562.

The opening/closing body 561 forms one component of the opening/closing member 560. The opening/closing body 561 may open or close the clean inlet part 130. The opening/closing body 561 may have a shape corresponding to the shape of an opening formed in the clean inlet part 130 or the support body 531 (i.e., an opening closed by the opening/closing body 561). In the illustrated embodiment, the opening/closing body 561 is provided in a quadrangular plate shape with a length in the front-rear direction, a height in the up-down direction, and a thickness in the left-right direction.

One end in the longitudinal direction of the opening/closing body 561, that is, the front end in the illustrated embodiment, may be accommodated in the limiting space 533 and in contact with the limiting protrusion 532 as the opening/closing body 561 rotates. The opening/closing shaft member 562 is coupled to the other end in the longitudinal direction of the opening/closing body 561, that is, the rear end in the illustrated embodiment.

The opening/closing shaft member 562 functions as a rotation axis of the opening/closing body 561. The opening/closing shaft member 562 is coupled to the opening/closing body 561 and the opening/closing power part 550, respectively. The opening/closing shaft member 562 extends in the height direction of the opening/closing body 561, that is, in the up-down direction in the illustrated embodiment.

One end of the opening/closing shaft member 562 in the extension direction, that is, the upper end in the illustrated embodiment, penetrates the upper surface of the support body 531 and is coupled to the gear member 552. The other end of the opening/closing shaft member 562 in the extension direction, that is, the lower end in the illustrated embodiment, is rotatably supported on the inner surface of the support body 531.

The opening/closing shaft member 562 is located biased on one side in the longitudinal direction of the opening/closing body 561, that is, on the rear side in the illustrated embodiment. Alternatively, the opening/closing shaft member 562 may be located biased on the other side in the longitudinal direction of the opening/closing body 561, that is, on the front side in the illustrated embodiment. In the above embodiment, it will be understood that the direction in which the opening/closing member 560 is rotated to open or close the clean inlet part 130 is opposite to the rotation direction according to the above-described embodiment.

Each configuration of the flow passage forming unit 500 described above assumes that the opening/closing member 560 is rotated in the horizontal direction. Alternatively, the opening/closing member 560 may be provided to be able to be lifted up and down in the vertical direction, or may be provided to be able to be lifted up and down in the front-rear direction, or in the left-right direction. In any case, it is sufficient for the opening/closing member 560 to be configured to open or close the clean inlet part 130.

The branch member 570 branches the flow of air or dust, etc. introduced into the dust inlet part 140. By the branch member 570, the introduced air may be divided and flow into the plurality of first connection flow passages 534. Accordingly, the introduced air may flow to the air purification unit 300 along a plurality of flow passages formed inside the air purifier 10.

The branch member 570 is located in the second connection flow passage 535. The branch member 570 may be arranged at any position capable of dividing the flow of air introduced into the second connection flow passage 535 through the dust inlet part 140. In the illustrated embodiment, the branch member 570 is located in the middle portion of the second connection flow passage 535, that is, in the central portion of the second connection flow passage 535 along the left-right direction.

The branch member 570 may be of any shape capable of dividing the flow of air introduced into the second connection flow passage 535. In the illustrated embodiment, the branch member 570 has a disc shape having a circular cross-section and having a thickness in the up-down direction.

Referring to FIGS. 16 to 22, an air flow passage formed inside the air purifier 10 according to an embodiment of the present invention is shown as an example.

As described above, the air purifier 10 according to an embodiment of the present invention may suck air through a plurality of flow passages by rotating a single component, that is, the fan member 320.

Air introduced into the opening/closing member accommodation part 540 through the clean inlet part 130 may be purified through the air purification unit 300 and then be discharged to the outside again. In this case, dust, etc. mixed with the introduced air may fall out due to its own weight, fall along the first connection flow passage 534 that communicates with the opening/closing member accommodation part 540 and extends in the height direction, and be collected in the second connection flow passage 535.

In addition, air introduced into the dust inlet part 140 may flow into the air purification unit 300 by passing through the second connection flow passage 535, the first connection flow passage 534, and the opening/closing member accommodation part 540 in that order.

In this case, dust, etc. mixed with the introduced air may not enter the first connection flow passage 534 extending in the height direction, but may be separated and collected in the second connection flow passage 535. The collected dust, etc. may be removed by a vacuum cleaner or the like (not shown) inserted into the dust inlet part 140.

In another embodiment, the lower side of the second connection flow passage 535 may be surrounded by a tray or drawer that is withdrawably accommodated in the housing space 120. In the above embodiment, the tray or drawer may be withdrawn from the housing space 120, so that the trapped air can be easily removed.

Furthermore, in the air purifier 10 according to an embodiment of the present invention, the cross-sectional area of the flow passage through which air is introduced may be adjusted by rotating the opening/closing member 560. That is, if the opening/closing member 560 closes the clean inlet part 130, a stronger suction force may be applied to the dust inlet part 140 even when the fan member 320 is rotated in the same manner. Accordingly, dust, etc. remaining on the floor surface around the air purifier 10 can be more effectively sucked into the air purifier 10.

In addition, if the opening/closing member 560 opens the clean inlet part 130, external air may be introduced into the interior of the air purifier 10 through both the clean inlet part 130 and the dust inlet part 140. Accordingly, the air purification function and external dust removal function can be performed together.

Referring to FIGS. 16 to 19, the flow of air formed inside the air purifier 10 when the opening/closing member 560 closes the clean inlet part 130 is shown as an example.

In the above state, the opening/closing member 560 coupled to the first support part 530*a* rotates clockwise to close the first clean inlet part 131, and the opening/closing member 560 coupled to the second support part 530*b* rotates counterclockwise to close the second clean inlet part 132.

Accordingly, external air can be introduced into the air purifier 10 only through the dust inlet part 140.

When the fan member 320 operates, external air is introduced into the second connection flow passage 535 through the dust inlet part 140. In this case, the introduced air is the air staying adjacent to the floor surface around the air purifier 10, and dust, etc. remaining on the floor surface is also introduced into the second connection flow passage 535 through the dust inlet part 140 along with air.

Air and dust, etc. introduced into the second connection flow passage 535 are branched by the branch member 570 in the width direction of the air purifier 10, that is, in the left-right direction in the illustrated embodiment. Branched air and dust, etc. may flow into each of the plurality of first connection flow passages 534.

Figure 19:
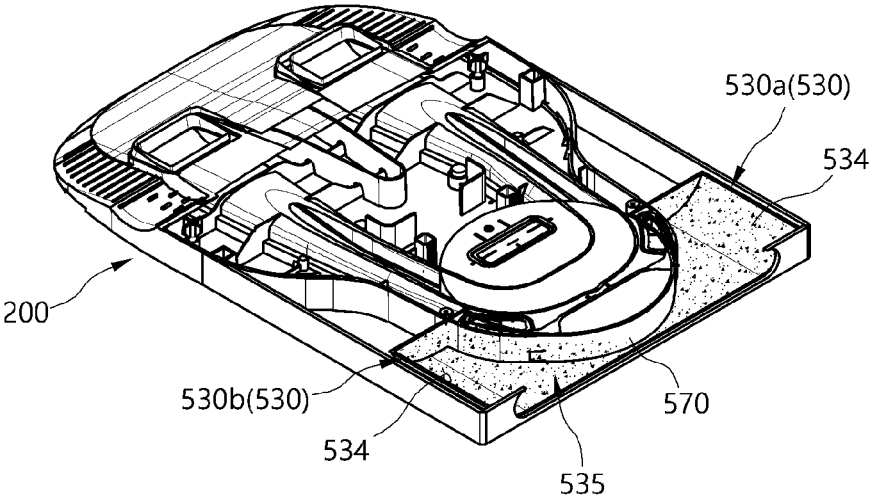

In this case, dust, etc., which has a relatively large mass compared to air, falls due to its own weight and stays in the second connection flow passage 535 (see FIG. 19).

The air introduced into the first connection flow passage 534 passes through the opening/closing member accommodation part 540 and the arm flow passage 523 in that order and is introduced into the purification flow passage 513. Since the purification flow passage 513 extends to surround the filter member 350 in the radial direction, air flows radially inward and is filtered while passing through the filter member 350. The filtered air flows out of the air purifier 10 through the purification housing 310 in communication with the filter member 350.

Therefore, dust, etc. remaining on the floor surface of the air purifier 10 may flow in with the air and be collected in the second connection flow passage 535. At the same time, the air introduced along with dust, etc. may be purified by the air purification unit 300 and then discharged out again.

Figure 20:
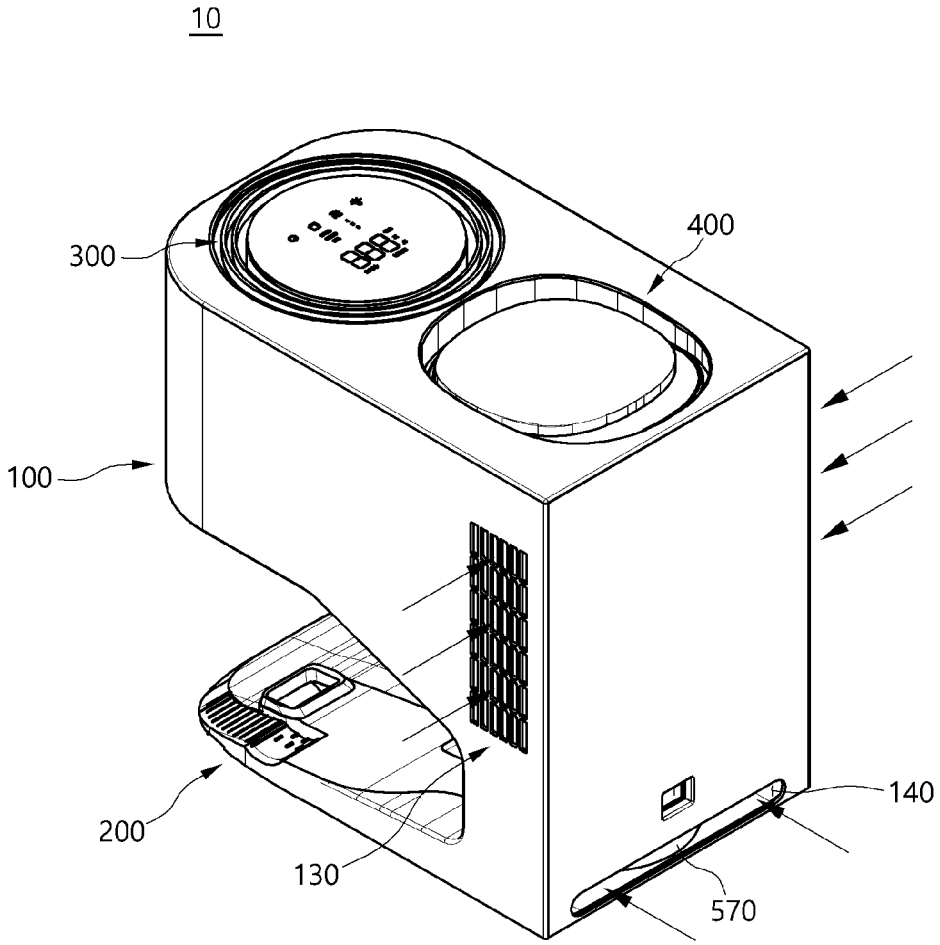
FIGS. 20 to 22 are usage state diagrams illustrating a state in which the air purifier of FIG. 1 is operated to perform both the dust, etc. suction function and the air purification function.
Figure 22:
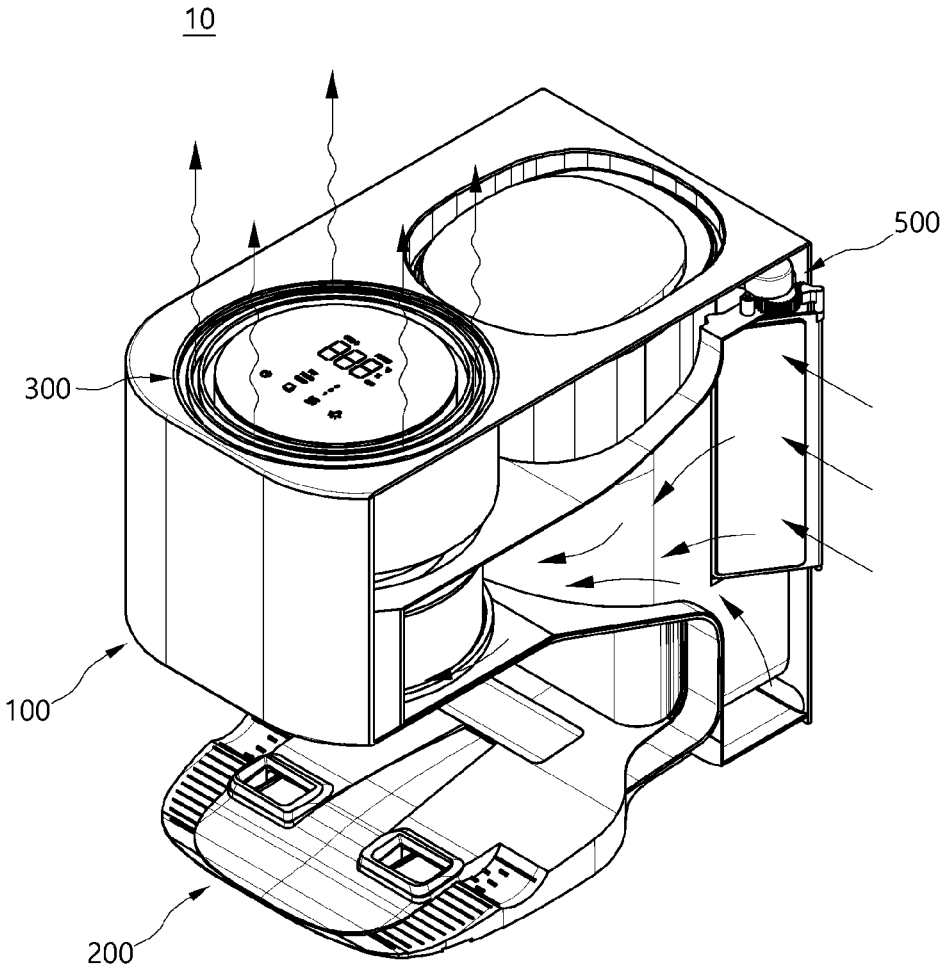

Referring to FIGS. 20 to 22, the flow of air formed inside the air purifier 10 when the opening/closing member 560 opens the clean inlet part 130 is shown as an example.

In the above state, the opening/closing member 560 coupled to the first support part 530*a* rotates counterclockwise to open the first clean inlet part 131, and the opening/closing member 560 coupled to the second support part 530*b* rotates clockwise to open the second clean inlet part 132.

Accordingly, external air can be introduced into the air purifier 10 both through the clean inlet part 130 and the dust inlet part 140.

When the fan member 320 operates, external air is introduced into the opening/closing member accommodation part 540 through the clean inlet part 130. In this case, the introduced air or dust, etc. is located relatively above the air that is introduced through the dust inlet part 140. Therefore, it will be understood that the above dust, etc. is relatively light compared to the dust, etc. that is introduced through the dust inlet part 140.

In this case, the dust, etc. introduced together with the air, falls due to its own weight and stays in the second connection flow passage 535 through the first connection flow passage 534.

In addition, external air is introduced into the second connection flow passage 535 through the dust inlet part 140 due to the conveying force applied by the fan member 320. In this case, the introduced air is the air staying adjacent to the floor surface around the air purifier 10, and dust, etc. remaining on the floor surface is also introduced into the second connection flow passage 535 through the dust inlet part 140 along with air.

Air and dust, etc. introduced into the second connection flow passage 535 are branched by the branch member 570 in the width direction of the air purifier 10, that is, in the left-right direction in the illustrated embodiment. Branched air and dust, etc. may be introduced into the opening/closing member accommodation part 540 through each of the plurality of first connection flow passages 534.

In this case, dust, etc., which has a relatively large mass compared to air, falls due to its own weight and stays in the second connection flow passage 535 (see FIG. 19).

The air introduced into the opening/closing member accommodation part 540 is sequentially introduced into the arm flow passage 523 and the purification flow passage 513. Since the purification flow passage 513 extends to surround the filter member 350 in the radial direction, air flows radially inward and is filtered while passing through the filter member 350. The filtered air flows out of the air purifier 10 through the purification housing 310 in communication with the filter member 350.

Therefore, dust, etc. remaining on the floor surface of the air purifier 10 may flow in with the air and be collected in the second connection flow passage 535. At the same time, the air introduced along with dust, etc. may be purified by the air purification unit 300 and then discharged out again.

Although exemplary embodiments of the present invention have been described, the idea of the present invention is not limited to the embodiments set forth herein. Those of ordinary skill in the art who understand the idea of the present invention may easily propose other embodiments through supplement, change, removal, addition, etc. of elements within the same idea, but the embodiments will be also within the scope of the present invention.

<Description of Symbols>

| | |
|---|---|
| 10: air purifier | 100: housing |
| 110: housing body | 111: first housing surface |
| 112: second housing surface | 113: third housing surface |
| 114: fourth housing surface | 115: first rack |
| 116: second rack | 120: housing space |
| 130: clean inlet part | 131: first clean inlet part |

-continued

| <Description of Symbols> | |
|---|---|
| 132: second clean inlet part | 140: dust inlet part |
| 150: support rib | 151: purification coupling hole |
| 152: collection coupling hole | 160: housing cover |
| 161: first housing cover | 161a: first cover coupling hole |
| 161b: second cover coupling hole | 162: second housing cover |
| 200: base | 300: air purification unit |
| 310: purification housing | 320: fan member |
| 330: power member | 340: control member |
| 350: filter member | 400: dust collection unit |
| 500: flow passage forming unit | 510: purification support part |
| 511: purification accommodation part | 512: dust accommodation part |
| 513: purification flow passage | 520: flow passage arm |
| 521: first flow passage arm | 522: second flow passage arm |
| 523: arm flow passage | 530: opening/closing member support part |
| 530a: first support part | 530b: second support part |
| 531: support body | 532: limiting protrusion |
| 533: limiting space | 534: first connection flow passage |
| 535: second connection flow passage | 540: opening/closing member accommodation part |
| 541: first accommodation part | 542: second accommodation part |
| 550: opening/closing power part | 551: motor member |
| 552: gear member | 560: opening/closing member |
| 561: opening/closing body | 562: opening/closing shaft member |
| 570: branch member | |

What is claimed is:

1. An air purifier, comprising:

a housing that forms an external shape and has a housing space therein that communicates with the outside; and an air purification unit that is coupled to the housing, comprises a fan member that provides a conveying force to allow external air to be introduced into the housing space of the housing, and a filter member that filters external air introduced into the housing space, and purifies the external air introduced into the housing space and then discharges it to the outside, wherein the housing comprises:

a clean inlet part partially surrounding the housing space, formed through one or more surfaces of the housing, and communicating the outside into the housing space in order to introduce the external air into the housing space and the outside; and a dust inlet part partially surrounding the housing space, formed through one or more surfaces of the housing, and communicating the outside into the housing space and the outside at a position different from the clean inlet part, wherein the clean inlet part is configured to be open or closed, and when the clean inlet part is closed, the speed of external air introduced into the dust inlet part is increased by the fan member, wherein a power member is coupled to the fan member and configured to rotate the fan member, wherein the air purification unit comprises:

a control member energizably connected to the power member and configured to apply a control signal or power to the power member, wherein the control member is configured to control the power member such that a rotation speed of the power member is increased when the clean inlet part is closed;

wherein the air purifier further comprises a flow passage forming unit;

wherein the flow passage forming unit is accommodated in the housing space and is in communication with the housing space and the outside, respectively, to form a flow passage through which external air flows to the air purification unit, and wherein the flow passage forming unit comprises:

a purification support part that supports the air purification unit and has a purification flow passage formed therein communicating with the air purification unit;

an opening/closing member that opens or closes the clean inlet part; and an opening/closing member support part that is continuous with the purification support part, is located adjacent to the clean inlet part, and includes a connection flow passage therein communicating with the purification flow passage, wherein the opening/closing member is rotatably coupled to the opening/closing member support part.

2. The air purifier of claim 1, wherein a lower end of the dust inlet part is located lower than a lower end of the clean inlet part.

3. The air purifier of claim 2, wherein the dust inlet part is formed extending in the width direction of the housing.

4. The air purifier of claim 1, wherein the opening/closing member rotates about an axis parallel to an extension direction of the clean inlet part to open or close the clean inlet part.

5. The air purifier of claim 4, wherein the flow passage forming unit comprises:

an opening/closing member accommodation part that is formed open on one side of each side of the opening/closing member support part facing the clean inlet part, communicates the outside and the connection flow passage, and rotatably accommodates the opening/closing member.

6. The air purifier of claim 4, wherein the flow passage forming unit comprises:

a limiting protrusion protruding from the other side of each side of the opening/closing member support part opposite to the clean inlet part; and a limiting space formed inside the limiting protrusion, communicating with the connection flow passage, and partially accommodating the opening/closing member rotated to open the clean inlet part.

7. The air purifier of claim 4, wherein the connection flow passage of the opening/closing member support part comprises:

a first connection flow passage that communicates with an inner space of the opening/closing member support part and the dust inlet part, and forms a part of a flow passage in which external air introduced through the dust inlet part is directed to the air purification unit; and a second connection flow passage between the first connection flow passage and the dust inlet part, respectively communicating with the first connection flow passage and the dust inlet part, and forming a flow passage through which external air introduced into the dust inlet part flows into the first connection flow passage.

8. The air purifier of claim 7, wherein the opening/closing member support part is composed of at least two extended parts that are continuous with each other and extend in different directions, the first connection flow passage is formed inside any one of the at least two extended parts, and the second connection flow passage is formed inside the other one of the at least two extended parts.

9. The air purifier of claim 8, wherein the dust inlet part extends in the width direction of the housing, the second connection flow passage extends in one direction corresponding to the extension direction of the dust inlet part, and the first connection flow passage extends in the other direction at a predetermined angle with one end of the extension direction of the second connection flow passage.

10. The air purifier of claim 9, wherein the flow passage forming unit comprises:

a part of the first connection flow passage extending in the height direction of the housing and communicating with the filter member; and a part of the second connection flow passage communicating with the first connection flow passage, extending in the width direction of the housing, located adjacent to the dust inlet part, and communicating with the dust inlet part.

11. The air purifier of claim 10, wherein at least some of foreign matters mixed with introduced external air falls on one surface of inner surfaces of the flow passage forming unit surrounding the second connection flow passage from the lower side and is collected.

12. The air purifier of claim 1, wherein the dust inlet part is formed through a lower end of one or more of the surfaces of the housing partially surrounding the housing space.

* * * * *